US008123606B2

(12) United States Patent
Hollibaugh et al.

(10) Patent No.: US 8,123,606 B2
(45) Date of Patent: Feb. 28, 2012

(54) STUD BINGO

(75) Inventors: Larry Hollibaugh, Reno, NV (US); Ted Gail, Sparks, NV (US); Bryan Wolf, Reno, NV (US)

(73) Assignee: IGT, Reno, NV (US)

( * ) Notice: Subject to any disclaimer, the term of this patent is extended or adjusted under 35 U.S.C. 154(b) by 1172 days.

(21) Appl. No.: 11/031,048

(22) Filed: Jan. 7, 2005

(65) Prior Publication Data

US 2006/0025189 A1 Feb. 2, 2006

Related U.S. Application Data

(60) Provisional application No. 60/592,410, filed on Jul. 30, 2004.

(51) Int. Cl.
*A63F 9/24* (2006.01)

(52) U.S. Cl. ..... 463/19; 463/22; 463/25

(58) Field of Classification Search ..... 463/13, 463/16, 19, 20, 22, 25; 273/269
See application file for complete search history.

(56) References Cited

U.S. PATENT DOCUMENTS

| | | | | |
|---|---|---|---|---|
| 1,723,377 | A | 8/1929 | Salomon | |
| 3,618,952 | A | 11/1971 | Tallarida | |
| 3,628,259 | A | 12/1971 | Kahn | |
| 4,156,976 | A | 6/1979 | Mikun | |
| 4,157,829 | A | 6/1979 | Goldman et al. | |
| 4,332,389 | A | 6/1982 | Loyd, Jr. et al. | 463/19 |
| 4,335,809 | A | 6/1982 | Wain | |
| 4,339,798 | A | 7/1982 | Hedges et al. | |
| 4,364,567 | A | 12/1982 | Goott | |
| 4,365,810 | A | 12/1982 | Richardson | 273/237 |
| 4,371,169 | A | 2/1983 | Compton | |
| 4,373,726 | A | 2/1983 | Churchill et al. | 463/19 |
| 4,448,419 | A | 5/1984 | Telnaes | |
| 4,455,025 | A | 6/1984 | Itkis | 273/237 |

(Continued)

FOREIGN PATENT DOCUMENTS

EP 0769769 4/1997

(Continued)

OTHER PUBLICATIONS

Diamonopoly Advertisement by International Gamco, Inc., published 2002. Electronic Pull Tabs Advertisement by 21st Century Gaming, published prior to 2002.

(Continued)

*Primary Examiner* — Omkar Deodhar
(74) *Attorney, Agent, or Firm* — Weaver Austin Villeneuve & Sampson LLP

(57) ABSTRACT

The present invention provides methods and devices for providing wagering games having aspects of card games, such as poker games. Some implementations of the present invention involve methods and devices for providing such wagering games on a network of gaming machines. In some implementations, players can view a first M playing cards from each of N hands of playing cards, then must select one (or more) of the hands. Thereafter, a playing card hand (e.g., a poker hand) is made up for the selected hand from the N cards and from additional cards that are revealed after the hand is selected. Some implementations provide a bingo game in which areas of each bingo card correspond with playing cards, wherein players may establish interim wins that correspond to poker hands. Some such implementations include displaying N bingo cards, each of which corresponds to one of the N hands of playing cards.

12 Claims, 13 Drawing Sheets

U.S. PATENT DOCUMENTS

| | | | | | |
|---|---|---|---|---|---|
| 4,467,424 | A | | 8/1984 | Hedges et al. | |
| 4,494,197 | A | | 1/1985 | Troy et al. | |
| 4,560,171 | A | * | 12/1985 | Anthony | 273/269 |
| 4,582,324 | A | | 4/1986 | Koza et al. | |
| 4,624,462 | A | | 11/1986 | Itkis | 273/237 |
| 4,652,998 | A | | 3/1987 | Koza et al. | |
| 4,669,730 | A | | 6/1987 | Small | |
| 4,689,742 | A | | 8/1987 | Troy et al. | |
| 4,743,022 | A | * | 5/1988 | Wood | 463/13 |
| 4,798,387 | A | | 1/1989 | Richardson | 273/237 |
| 4,805,907 | A | | 2/1989 | Hagiwara | |
| 4,815,741 | A | | 3/1989 | Small | |
| 4,817,951 | A | | 4/1989 | Crouch et al. | |
| 4,842,278 | A | | 6/1989 | Markowicz | |
| 4,848,771 | A | | 7/1989 | Richardson | 273/237 |
| 4,856,787 | A | | 8/1989 | Itkis | |
| 4,982,337 | A | | 1/1991 | Burr et al. | |
| 5,007,649 | A | | 4/1991 | Richardson | 463/25 |
| 5,011,159 | A | | 4/1991 | Fortunato et al. | |
| 5,042,809 | A | | 8/1991 | Richardson | |
| 5,078,403 | A | | 1/1992 | Chernowski, Jr. | |
| 5,092,598 | A | | 3/1992 | Kamille | |
| 5,100,137 | A | | 3/1992 | Fulton | |
| 5,100,139 | A | * | 3/1992 | Di Bella | 273/292 |
| 5,145,182 | A | | 9/1992 | Swift et al. | |
| 5,158,293 | A | | 10/1992 | Mullins | |
| 5,167,413 | A | | 12/1992 | Fulton | |
| 5,224,706 | A | | 7/1993 | Bridgeman et al. | |
| 5,242,163 | A | | 9/1993 | Fulton | 273/138 |
| 5,265,874 | A | | 11/1993 | Dickinson et al. | |
| 5,275,400 | A | | 1/1994 | Weingardt | |
| 5,276,312 | A | | 1/1994 | McCarthy | |
| 5,282,620 | A | | 2/1994 | Keesee | |
| 5,294,120 | A | | 3/1994 | Schultz | |
| 5,294,128 | A | | 3/1994 | Marquez | |
| 5,297,802 | A | | 3/1994 | Pocock et al. | 463/19 |
| 5,324,035 | A | * | 6/1994 | Morris et al. | 463/42 |
| 5,351,970 | A | | 10/1994 | Fioretti | 463/19 |
| 5,356,140 | A | * | 10/1994 | Dabrowski et al. | 463/12 |
| 5,393,057 | A | | 2/1995 | Marnell, II | |
| 5,398,932 | A | | 3/1995 | Eberhardt et al. | |
| 5,401,023 | A | | 3/1995 | Wood | |
| 5,407,199 | A | | 4/1995 | Gumina | |
| 5,482,289 | A | | 1/1996 | Weingardt | |
| 5,489,101 | A | | 2/1996 | Moody | |
| 5,511,781 | A | | 4/1996 | Wood et al. | |
| 5,531,448 | A | | 7/1996 | Moody | |
| 5,542,669 | A | | 8/1996 | Charron et al. | |
| 5,570,885 | A | | 11/1996 | Ornstein | |
| 5,584,486 | A | | 12/1996 | Franklin | |
| 5,588,913 | A | | 12/1996 | Hecht | |
| 5,593,161 | A | | 1/1997 | Boylan et al. | |
| 5,628,684 | A | | 5/1997 | Boudec | |
| 5,630,754 | A | | 5/1997 | Rebane | |
| 5,639,088 | A | | 6/1997 | Schneider et al. | |
| 5,674,128 | A | | 10/1997 | Holch et al. | |
| 5,678,001 | A | | 10/1997 | Nagel et al. | |
| 5,707,285 | A | | 1/1998 | Place et al. | |
| 5,709,603 | A | * | 1/1998 | Kaye | 463/17 |
| 5,711,715 | A | | 1/1998 | Ringo et al. | |
| 5,718,431 | A | | 2/1998 | Ornstein | |
| 5,722,891 | A | | 3/1998 | Inoue | |
| 5,732,950 | A | | 3/1998 | Moody | |
| 5,755,619 | A | | 5/1998 | Matsumoto et al. | |
| 5,762,552 | A | | 6/1998 | Vuong et al. | 463/25 |
| 5,775,692 | A | | 7/1998 | Watts et al. | |
| 5,779,545 | A | | 7/1998 | Berg et al. | |
| 5,791,987 | A | | 8/1998 | Chen et al. | |
| 5,800,269 | A | | 9/1998 | Holch et al. | |
| 5,816,916 | A | | 10/1998 | Moody | |
| 5,823,873 | A | | 10/1998 | Moody | |
| 5,823,874 | A | | 10/1998 | Adams | |
| 5,833,537 | A | | 11/1998 | Barrie | |
| 5,833,540 | A | | 11/1998 | Miodunski et al. | |
| 5,848,932 | A | | 12/1998 | Adams | |
| 5,851,011 | A | | 12/1998 | Lott | |
| 5,868,619 | A | | 2/1999 | Wood et al. | |
| 5,871,398 | A | | 2/1999 | Schneier et al. | |
| 5,882,258 | A | | 3/1999 | Kelly et al. | |
| 5,882,260 | A | | 3/1999 | Marks et al. | |
| 5,944,606 | A | | 8/1999 | Gerow | |
| 5,949,042 | A | | 9/1999 | Dietz, II et al. | |
| 5,951,396 | A | | 9/1999 | Tawil | |
| 5,954,335 | A | | 9/1999 | Moody | |
| 5,954,582 | A | | 9/1999 | Zach | |
| 5,976,016 | A | | 11/1999 | Moody et al. | |
| 5,984,310 | A | | 11/1999 | English | |
| 5,984,779 | A | | 11/1999 | Bridgeman et al. | |
| 6,007,066 | A | | 12/1999 | Moody | |
| 6,007,424 | A | | 12/1999 | Evers et al. | |
| 6,012,720 | A | | 1/2000 | Webb | |
| 6,012,981 | A | | 1/2000 | Fujioka et al. | |
| 6,012,984 | A | | 1/2000 | Roseman | 463/42 |
| 6,017,032 | A | | 1/2000 | Grippo et al. | |
| 6,024,640 | A | | 2/2000 | Walker et al. | |
| 6,062,980 | A | | 5/2000 | Luciano | |
| 6,079,711 | A | * | 6/2000 | Wei et al. | 273/269 |
| 6,089,982 | A | | 7/2000 | Holch et al. | |
| 6,093,100 | A | | 7/2000 | Singer et al. | 463/13 |
| 6,098,985 | A | | 8/2000 | Moody | |
| 6,120,378 | A | | 9/2000 | Moody et al. | |
| 6,126,541 | A | | 10/2000 | Fuchs | |
| 6,126,542 | A | | 10/2000 | Fier | |
| 6,132,311 | A | | 10/2000 | Williams | |
| 6,146,271 | A | | 11/2000 | Kadlic | |
| 6,146,272 | A | | 11/2000 | Walker et al. | |
| 6,149,156 | A | | 11/2000 | Feola | |
| 6,149,521 | A | | 11/2000 | Sanduski | |
| 6,159,095 | A | | 12/2000 | Frohm et al. | |
| 6,168,521 | B1 | | 1/2001 | Luciano et al. | |
| 6,174,233 | B1 | | 1/2001 | Sunaga et al. | |
| 6,183,361 | B1 | | 2/2001 | Cummings et al. | |
| 6,190,255 | B1 | | 2/2001 | Thomas et al. | |
| 6,196,547 | B1 | | 3/2001 | Pascal et al. | |
| 6,203,429 | B1 | | 3/2001 | Demar et al. | |
| 6,210,275 | B1 | | 4/2001 | Olsen | |
| 6,210,276 | B1 | | 4/2001 | Mullins | |
| 6,217,448 | B1 | | 4/2001 | Olsen | |
| 6,220,961 | B1 | | 4/2001 | Keane et al. | |
| 6,241,606 | B1 | | 6/2001 | Riendeau et al. | |
| 6,254,480 | B1 | | 7/2001 | Zach | |
| 6,257,980 | B1 | | 7/2001 | Santini, Jr. | |
| 6,273,424 | B1 | | 8/2001 | Breeding | |
| 6,273,820 | B1 | | 8/2001 | Haste, III | |
| 6,280,325 | B1 | | 8/2001 | Fisk | 463/19 |
| 6,280,328 | B1 | | 8/2001 | Holch et al. | |
| 6,309,298 | B1 | | 10/2001 | Gerow | |
| 6,312,334 | B1 | | 11/2001 | Yoseloff | |
| 6,325,716 | B1 | | 12/2001 | Walker et al. | |
| 6,358,151 | B1 | | 3/2002 | Enzminger et al. | |
| 6,368,218 | B2 | | 4/2002 | Angell, Jr. | |
| 6,394,456 | B1 | | 5/2002 | Long | |
| 6,398,645 | B1 | * | 6/2002 | Yoseloff | 463/19 |
| 6,402,614 | B1 | | 6/2002 | Schneier et al. | 463/17 |
| 6,419,583 | B1 | | 7/2002 | Crumby et al. | |
| 6,425,824 | B1 | | 7/2002 | Baerlocher et al. | |
| 6,450,885 | B2 | | 9/2002 | Schneier et al. | |
| 6,454,648 | B1 | | 9/2002 | Kelly et al. | |
| RE37,885 | E | | 10/2002 | Acres et al. | |
| 6,475,086 | B2 | | 11/2002 | Zach | |
| 6,494,454 | B2 | | 12/2002 | Adams | |
| 6,508,711 | B1 | | 1/2003 | Ono | |
| 6,511,068 | B1 | * | 1/2003 | Sklansky et al. | 273/237 |
| 6,524,184 | B1 | | 2/2003 | Lind et al. | |
| 6,524,185 | B2 | | 2/2003 | Lind | 463/19 |
| 6,527,638 | B1 | | 3/2003 | Walker et al. | |
| 6,533,664 | B1 | | 3/2003 | Crumby | |
| 6,537,150 | B1 | | 3/2003 | Luciano et al. | |
| 6,554,283 | B2 | | 4/2003 | Vancura et al. | |
| 6,568,677 | B2 | | 5/2003 | Brenner | |
| 6,569,017 | B2 | | 5/2003 | Enzminger et al. | 463/19 |
| 6,575,467 | B1 | | 6/2003 | Kal | |
| 6,585,266 | B1 | | 7/2003 | Lovell | |
| 6,585,590 | B2 | | 7/2003 | Malone | |
| 6,599,187 | B2 | | 7/2003 | Gerow | |
| 6,607,439 | B2 | | 8/2003 | Schneier et al. | |
| 6,609,974 | B2 | | 8/2003 | Mead et al. | |

| | | | | |
|---|---|---|---|---|
| 6,612,927 | B1 | 9/2003 | Slomiany et al. | |
| 6,619,660 | B2 | 9/2003 | Schaefer et al. | |
| 6,656,044 | B1 | 12/2003 | Lewis | 463/19 |
| 6,676,126 | B1 | 1/2004 | Walker et al. | |
| 6,685,562 | B1 | 2/2004 | Rantanen | |
| 6,695,695 | B2 * | 2/2004 | Angel | 463/13 |
| 6,722,655 | B1 | 4/2004 | Camero | |
| 6,729,621 | B2 | 5/2004 | Moody | |
| 6,729,961 | B1 | 5/2004 | Millerschone | |
| 6,733,385 | B1 | 5/2004 | Enzminger et al. | |
| 6,739,970 | B2 | 5/2004 | Luciano | |
| 6,743,102 | B1 | 6/2004 | Fiechter et al. | |
| 6,749,500 | B1 | 6/2004 | Nelson et al. | |
| 6,780,108 | B1 | 8/2004 | Luciano | |
| 6,802,776 | B2 | 10/2004 | Lind et al. | |
| 6,802,778 | B1 | 10/2004 | Lemay et al. | |
| 6,805,629 | B1 | 10/2004 | Weiss | |
| 6,840,858 | B2 | 1/2005 | Adams | |
| 6,874,784 | B1 * | 4/2005 | Promutico et al. | 273/292 |
| 6,918,831 | B2 | 7/2005 | Nguyen et al. | |
| 6,923,719 | B2 | 8/2005 | Wolf | |
| 6,932,707 | B2 | 8/2005 | Duhamel | |
| 7,059,966 | B2 | 6/2006 | Luciano | |
| 7,128,647 | B2 | 10/2006 | Muir | |
| 7,481,707 | B1 | 1/2009 | Luciano et al. | |
| 7,955,170 | B2 | 6/2011 | Gail et al. | |
| 2001/0036855 | A1 | 11/2001 | DeFrees-Parrott et al. | 463/17 |
| 2001/0046892 | A1 | 11/2001 | Santini, Jr. | |
| 2002/0010013 | A1 | 1/2002 | Walker et al. | |
| 2002/0094869 | A1 | 7/2002 | Harkham | 463/42 |
| 2002/0098882 | A1 | 7/2002 | Lind et al. | |
| 2002/0098883 | A1 | 7/2002 | Packes, Jr. et al. | |
| 2002/0111207 | A1 | 8/2002 | Lind et al. | 463/19 |
| 2002/0113369 | A1 | 8/2002 | Weingardt | 273/269 |
| 2002/0132661 | A1 | 9/2002 | Lind et al. | 463/19 |
| 2002/0155877 | A1 | 10/2002 | Enzminger et al. | |
| 2002/0196342 | A1 | 12/2002 | Walker et al. | |
| 2003/0060257 | A1 | 3/2003 | Katz et al. | |
| 2003/0060261 | A1 | 3/2003 | Katz et al. | |
| 2003/0060276 | A1 | 3/2003 | Walker et al. | |
| 2003/0098544 | A1 | 5/2003 | Tarantino | |
| 2003/0125101 | A1 | 7/2003 | Campo | 463/19 |
| 2003/0127793 | A1 | 7/2003 | Adams | |
| 2003/0144050 | A1 | 7/2003 | Keaton et al. | |
| 2003/0162577 | A1 | 8/2003 | Hamud | |
| 2003/0181231 | A1 | 9/2003 | Vancura | |
| 2003/0190943 | A1 | 10/2003 | Walker et al. | |
| 2003/0216165 | A1 | 11/2003 | Singer | |
| 2003/0228899 | A1 | 12/2003 | Evans | |
| 2003/0236116 | A1 | 12/2003 | Marks | |
| 2004/0009806 | A1 | 1/2004 | Odom | |
| 2004/0023706 | A1 | 2/2004 | Hunter et al. | |
| 2004/0036212 | A1 | 2/2004 | Walker et al. | |
| 2004/0038723 | A1 | 2/2004 | Schneier et al. | |
| 2004/0053675 | A1 | 3/2004 | Nguyen et al. | |
| 2004/0072604 | A1 | 4/2004 | Toyoda | |
| 2004/0072605 | A1 * | 4/2004 | Toyoda | 463/16 |
| 2004/0077400 | A1 | 4/2004 | Marshall | |
| 2004/0132523 | A1 | 7/2004 | Staw | |
| 2004/0142747 | A1 | 7/2004 | Pryzby | |
| 2004/0152503 | A1 * | 8/2004 | Lind et al. | 463/16 |
| 2004/0152505 | A1 | 8/2004 | Herrmann et al. | |
| 2004/0152508 | A1 | 8/2004 | Lind et al. | |
| 2004/0166920 | A1 | 8/2004 | Boyd | |
| 2004/0185932 | A1 * | 9/2004 | Lombardo | 463/21 |
| 2004/0219969 | A1 * | 11/2004 | Casey et al. | 463/20 |
| 2004/0235542 | A1 | 11/2004 | Stronach | |
| 2004/0235555 | A1 * | 11/2004 | Yarbrough et al. | 463/19 |
| 2004/0259621 | A1 | 12/2004 | Pfeiffer et al. | |
| 2004/0266507 | A1 * | 12/2004 | Cooper | 463/13 |
| 2005/0026665 | A1 | 2/2005 | Gerrard et al. | |
| 2005/0037832 | A1 | 2/2005 | Cannon | |
| 2005/0037834 | A1 | 2/2005 | Stern et al. | |
| 2005/0054426 | A1 | 3/2005 | Toyoda | |
| 2005/0059449 | A1 | 3/2005 | Yarbrough | |
| 2005/0059469 | A1 | 3/2005 | Gail et al. | |
| 2005/0059471 | A1 * | 3/2005 | Cannon | 463/19 |
| 2005/0096130 | A1 | 5/2005 | Mullins | |
| 2005/0098944 | A1 | 5/2005 | Brandstetter | |
| 2005/0101387 | A1 | 5/2005 | Wolf | |
| 2005/0167916 | A1 | 8/2005 | Banyai | |
| 2005/0221883 | A1 | 10/2005 | Lind et al. | |
| 2005/0233798 | A1 | 10/2005 | Van Asdale | |
| 2006/0025198 | A1 | 2/2006 | Gail et al. | |
| 2006/0025199 | A1 | 2/2006 | Harkins et al. | |
| 2006/0217176 | A1 | 9/2006 | Walker | |
| 2007/0093286 | A1 | 4/2007 | Marshall | |
| 2007/0135211 | A1 | 6/2007 | Block et al. | |
| 2007/0142113 | A1 | 6/2007 | Walker et al. | |
| 2008/0070663 | A1 * | 3/2008 | Losilevsky | 463/13 |

FOREIGN PATENT DOCUMENTS

| | | |
|---|---|---|
| EP | 199690 | 4/2002 |
| EP | 1302914 | 4/2003 |
| EP | 1341135 | 9/2003 |
| EP | 1343125 | 9/2003 |
| WO | WO96/18174 | 6/1996 |
| WO | WO 96/18174 | 6/1996 |
| WO | WO 01/99067 | 12/2001 |
| WO | WO01/99067 | 12/2001 |
| WO | WO 03/063019 | 7/2003 |
| WO | WO 2004/095383 | 11/2004 |

OTHER PUBLICATIONS

Lucky Times California Lottery Newsletter published 1996. Instant Winner Advertisement by Williams/WMS Gaming, published prior to 2002.

Play it again Advertisement by International Gamco, Inc., published 2000.

International Search Report and Written Opinion of the International Searching Authority dated Jan. 24, 2005, for related PCT Application No. PCT/US2004/029906.

International Search Report and Written Opinion of the International Searching Authority dated Jan. 25, 2005, for related PCT Application No. PCT/US2004/029913.

International Search Report and Written Opinion of the International Searching Authority dated Jan. 24, 2005, for related PCT Application No. PCT/US2004/030093.

International Search Report and Written Opinion of the International Searching Authority dated Feb. 3, 2005, for related PCT Application No. PCT/US2004/030285.

International Search Report and Written Opinion of the International Searching Authority dated Feb. 3, 2005, for related PCT Application No. PCT/US2004/029839.

International Search Report & Written Opinion of the International Searching Authority dated Nov. 1, 2005, for PCT App No. PCT/US2004/029912.

EP Examiner's Communication, dated Jul. 3, 2006, from EP App No. 04783935.2.

EP Examiner's Communication, dated Jul. 3, 2006, from EP App No. 04784071.5.

EP Examiner's Communication, received Dec. 12, 2006, 2006, from EP App No. 04784069.9.

US Restriction Requirement mailed Jun. 8, 2007, from U.S. Appl. No. 10/931,673.

US Office Action mailed Aug. 20, 2007, from U.S. Appl. No. 10/931,673.

US Office Action mailed Jul. 3, 2007, from U.S. Appl. No. 10/755,982.

International Search Report, mailed Jul. 6, 2007 from International App No. PCT/US2006/048264, 5 pp. including Notification of Transmittal.

Written Opinion of the International Searching Authority mailed Jul. 6, 2007 from International App No. PCT/US2006/048264, 7 pp.

International Search Report and Written Opinion of the International Searching Authority, mailed Jul. 4, 2007 from International Application No. PCT/US2006/047714, 11 pp including Notification of Transmittal.

US Office Action mailed Sep. 21, 2007, from U.S. Appl. No. 10/756,429.

US Office Action mailed Sep. 13, 2007, from U.S. Appl. No. 10/941,606.

US Office Action mailed Jun. 27, 2007, from U.S. Appl. No. 11/026,860
Examination Report from Related European Patent Application No. 04 778 725.2, dated Oct. 22, 2007, 9 pages.
US Office Action mailed Dec. 21, 2007, from U.S. Appl. No. 11/026,860.
US Office Action mailed Mar. 17, 2008, from U.S. Appl. No. 10/937,227.
US Office Action mailed Sep. 12, 2007, from U.S. Appl. No. 10/969,127.
Aho et al., *Data Structures and Algorithms*, Addison-Wesley, 1983, pp. 13-16, 56-57, 260-261.
US Office Action mailed Apr. 3, 2008 from U.S. Appl. No. 10/969,127.
US Office Action mailed Jul. 9, 2008 from U.S. Appl. No. 11/026,860.
US Office Action dated Sep. 16, 2008 issued in U.S. Appl. No. 10/969,127.
US Office Action dated Nov. 17, 2008 issued in U.S. Appl. No. 10/937,227.
US Final Office Action dated Apr. 3, 2009 issued in U.S. Appl. No. 10/969,127.
US Office Action dated Apr. 8, 2009 issued in U.S. Appl. No. 11/026,860.
US Final Office Action dated Jun. 17, 2009 issued in U.S. Appl. No. 10/937,227.
US Office Action dated Jul. 2, 2009 issued in U.S. Appl. No. 10/925,710.
US Office Action dated Dec. 2, 2009 issued in U.S. Appl. No. 11/149,828.
US Office Action dated May 27, 2010 issued in U.S. Appl. No. 11/149,828.
US Office Action dated Jan. 12, 2010 issued in U.S. Appl. No. 10/937,227.
US Office Action dated Jul. 13, 2010 issued in U.S. Appl. No. 10/937,227.
US Examiner Interview Summary Record dated Jan. 24, 2008 issued in U.S. Appl. No. 10/969,127.
US Pre-Brief Appeal Conference Decision dated Aug. 21, 2009 issued in U.S. Appl. No. 10/969,127.
US Examiner Interview Summary Record dated Sep. 4, 2009 issued in U.S. Appl. No. 10/969,127.
US Office Action dated Dec. 22, 2009 issued in U.S. Appl. No. 10/969,127.
US Examiner Interview Summary Record dated Mar. 31, 2010 issued in U.S. Appl. No. 10/969,127.
US Final Office Action dated Jul. 2, 2010 issued in U.S. Appl. No. 10/969,127.
Encyclopedia > Suit (cards) NationMaster.com [online], [retrieved on Apr. 7, 2010]. Retrieved from the Internet <URL:http:www.statemaster.com/encyclopedia/Suit(cards)>, 9 pages.
US Office Action Final dated Feb. 28, 2011 issued in U.S. Appl. No. 10/925,710.
US Notice of Allowance dated Jun. 27, 2011 issued in U.S. Appl. No. 10/925,710.
US Notice of Allowance and Examiner's Interview Summary dated Mar. 28, 2011 issued in U.S. Appl. No. 10/969,127.

* cited by examiner

STUD BINGO

CROSS-REFERENCE TO RELATED APPLICATIONS

This application claims priority to U.S. Provisional Patent Application No. 60/592,410, entitled "Draw Bingo" and filed Jul. 30, 2004, which is hereby incorporated by reference for all purposes.

BACKGROUND OF THE INVENTION

The present disclosure relates to methods and devices for providing wagering games, particularly via a gaming network.

Gaming in the United States is divided into Class I, Class II and Class III games. Class I gaming includes social games played for minimal prizes, or traditional ceremonial games. Class II gaming includes bingo and bingo-like games. Bingo includes games played for prizes, including monetary prizes, with cards bearing numbers or other designations in which the holder of the cards covers such numbers or designations when objects, similarly numbered or designated, are drawn or electronically determined, and in which the game is won by the first person covering a previously designated arrangement of numbers or designations on such cards. Such an arrangement will sometimes be referred to herein as a "game-winning pattern" or a "game-ending pattern." Class II gaming may also include pull tab games if played in the same location as bingo games, lotto, punch boards, tip jars, instant bingo, and other games similar to bingo. Class III gaming includes any game that is not a Class I or Class II game, such as games of chance typically offered in non-Indian, state-regulated casinos.

Two basic forms of bingo exist. In traditional bingo, the players purchase cards after which a draw takes place. The first player to achieve a designated pattern wins. In one type of bingo game known as Bonanza Bingo, the draw for the game takes place before the players know the arrangements on their bingo cards. After the draw occurs, the players may purchase cards and compare the arrangements on the cards to the drawn numbers to determine whether predetermined patterns are matched. Play continues in Bonanza Bingo until at least one of the players matches a designated game-winning pattern. Bonanza Bingo may also encompass bingo variations wherein a partial draw is conducted for some numbers (generally fewer than the number of balls expected to be necessary to win the game) prior to selling the bingo cards. After the bingo cards are sold, additional numbers are drawn until there is a winner.

As indicated above, a bingo game is played until at least one player covers a predetermined game-winning pattern on the player's bingo card. The game may also include interim winners of prizes based on matching predetermined interim patterns on the bingo card using the same ball draw. The interim pattern wins do not terminate the bingo game. For interim pattern awards, players covering certain interim patterns may receive an additional award as the game continues. Some exceptional bingo versions may allow bingo draws beyond those needed to achieve the bingo game win so as to pay out interim pattern wins at a desired rate. The game-winning awards are generally pari-mutuel in nature. That is, the bingo win award is based upon the total amount wagered on a given occurrence of the bingo game. However, interim pattern awards typically are not pari-mutuel.

Gaming machines such as slot machines and video poker machines have proven to be very popular. However, many games of chance that are played on gaming machines fall into the category of Class III games, which may be subject to stricter approval and regulation. Many gaming establishments have a limited number of gaming machines for playing Class III games and a greater number of gaming machines for playing Class II games, such as bingo.

As such, it would be desirable to provide a Class II game with at least some of the "look and feel" of a Class III game. For example, it would be desirable to provide a gaming system wherein a Class II game with characteristics of a Class III game may be played on a gaming machine. For example, prior art systems have failed to provide a bingo game on a network of gaming machines that satisfies the regulatory requirements for a Class II game while simulating important aspects of a Class III card game, such as a poker game.

SUMMARY OF THE INVENTION

The present invention provides methods and devices for providing wagering games having aspects of card games, such as poker games. Some implementations of the present invention involve methods and devices for providing such wagering games on a network of gaming machines.

In some implementations, players can view a first M playing cards from each of N hands of playing cards, then must select one (or more) of the hands. Thereafter, a playing card hand (e.g., a poker hand) is made up for the selected hand from the N cards and from additional cards that are revealed after the hand is selected. Some implementations provide a bingo game in which areas of each bingo card correspond with playing cards, wherein players may establish interim wins that correspond to poker hands. Some such implementations include displaying N bingo cards, each of which corresponds to one of the N hands of playing cards. Some implementations provide for automatic daubing of the best cards in the final hand. In some implementations, only the highest-ranking interim win results in a payout. Players may also be eligible for a system win and, in some implementations, a progressive win.

Some methods of the invention provide a wagering game. The wagering game includes the following steps: displaying M cards for each of N hands of cards; allowing a player to choose at least one of the N hands; displaying remaining cards to complete a chosen hand; and determining whether the player is entitled to an award for a chosen hand. The allowing step may involve allowing the player to choose more than one of the N hands.

The wagering game may also involve awarding a player having a chosen hand with at least a threshold card combination. Remaining cards may be displayed to complete a non-chosen hand. A player may be offered, prior to the allowing step, to view one or more additional cards in at least one of the N hands of cards.

The displaying steps may involve making displays on a display device. The wagering game may also include the steps of providing a game outcome to a machine that controls the display device and displaying cards on the display device that correspond with the game outcome.

The player's award, if any, may or not depend on which hand is chosen. For example, when the wagering game is a central determination game, the award will not depend on which hand is chosen. The wagering game preferably includes the step of displaying cards to complete a non-chosen hand. The remaining cards in at least one non-chosen hand may be selected to have a higher card combination than that of the chosen hand.

Alternative gaming methods are provided herein. Some such methods include these steps: displaying N bingo cards to each of a plurality of bingo players, where N is a first predetermined integer; drawing M random bingo numbers corresponding to areas of at least some of the M bingo cards, where M is a second predetermined integer; displaying hits on the N bingo cards based on the M random bingo numbers; allowing each player an opportunity to select at least one bingo card for continued game play; and drawing one or more additional random bingo numbers and displaying hits on each player's selected bingo card until at least one interim win pattern is completed. The displays may be presented on a display device.

The player may be allowed to choose more than one of the N bingo cards. An interim win award may be made to a player having a chosen bingo card with at least a threshold interim win pattern. Hits may be displayed on non-selected bingo cards. Random bingo numbers may be drawn until a game-winning pattern is completed on a player's selected bingo card.

The method may include the following steps: providing a game outcome to the player; and receiving the game outcome by a machine that controls the display device, wherein the displaying steps comprise displaying game results on the display device that correspond with the game outcome.

The player's award, if any, may or may not depend on which hand is chosen. The remaining hits in at least one non-chosen bingo card may be selected to have a higher-level pattern than that of the chosen bingo card.

Some implementations of the invention provide a gaming network for playing electronic wagering games. The gaming network includes a plurality of gaming machines and at least one network device, such as a game server. The game server may be configured to transmit game data to control the plurality of gaming machines to conduct an electronic game of chance that allows one of a plurality of players to achieve a game-winning outcome.

In some such implementations, the game server controls each of the plurality of gaming machines to do the following: display M cards for each of N hands of cards; allow a player to choose at least one of the N hands; and display remaining cards to complete a chosen hand; wherein the game server is configured to determine whether a player is entitled to an award for a chosen hand.

Some embodiments of the invention provide a gaming machine. The gaming machine includes a port, a scanner, or some other device for receiving a game determination. For example, the gaming machine may include a port configured for receiving the game determination from a game server. Alternatively, or additionally, the gaming machine may include a scanner, card reader, etc., for receiving the game determination from a ticket or other medium provided by the player.

The gaming machine includes a display device for displaying M cards for each of N hands of cards and at least one interface for allowing a player to choose at least one of the N hands. The gaming machine is configured to display remaining cards to complete a chosen hand and to indicate whether a player is entitled to an award in accordance with the game determination.

Some implementations of the invention provide other hardware or software for providing wagering games according to any of the methods described herein. These and other features and advantages of the invention will be described in more detail below with reference to the associated drawings.

DESCRIPTION OF THE PREFERRED EMBODIMENTS

Reference will now be made in detail to some specific embodiments of the invention including the best modes contemplated by the inventors for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims. Moreover, numerous specific details are set forth below in order to provide a thorough understanding of the present invention. The present invention may be practiced without some or all of these specific details. In other instances, well known process operations have not been described in detail in order not to obscure the present invention.

Figure 1:
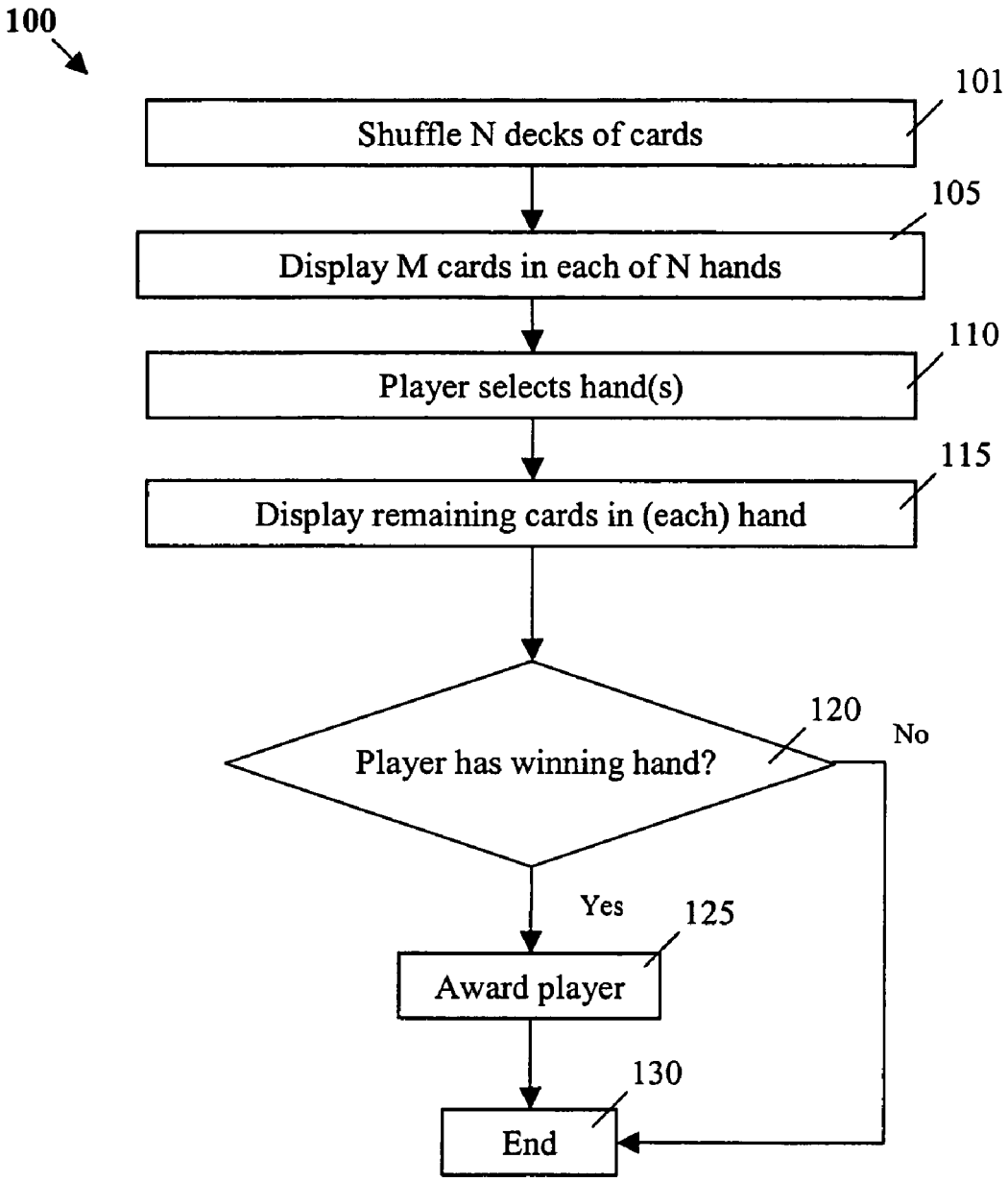
FIG. 1 is a flow chart that outlines some methods of the present invention.

FIG. 1 is a flowchart that provides an overview of some methods of the present invention. Method 100 may be performed manually, by a gaming machine, by devices in a gaming network such as those described below, or otherwise. Those of skill in the art will appreciate that the steps of method 100 need not be performed (and in some implementations are not performed) in the order shown. Moreover, some implementations of method 100 may include more or fewer steps than those shown in FIG. 1.

In step 101, N decks of playing cards are shuffled and players place their bets. N may be any convenient integer. Step 105 is merely representative of a step of preparing to display playing cards (or representations of playing cards) in a random or quasi-random manner. Step 101 may be performed, for example, by one or more logic devices of a game server or another computing device in communication with a game server. In some implementations, representations of a random sequence of playing cards are generated using one or more RNG (random number generating) seeds, each of which will provide a known outcome. U.S. Pat. No. 6,533,664, entitled "Gaming System with Individualized Centrally Generated Random Number Generator Seeds," describes the use of RNG seeds and is hereby incorporated by reference for all purposes. Each of the RNG seeds has been pre-calculated to produce a predetermined outcome when processed by a pre-programmed "deterministic RNG." The RNG seeds may be transmitted, for example, from a gaming server to a gaming machine or similar device. The RNG seeds are advantageous for security purposes. Moreover, they are easy to implement because most existing gaming machines use an RNG. Replacing this with a deterministic RNG allows central determination games to be implemented with minimal changes to existing Class III gaming machines.

Figure 1A:
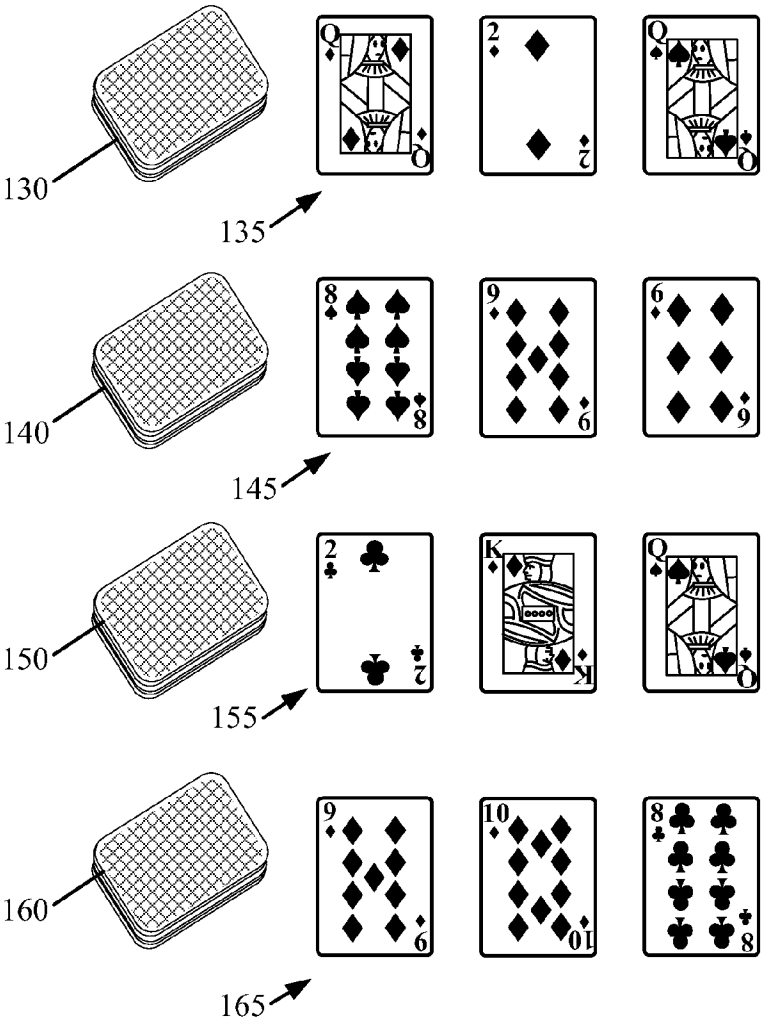
FIG. 1A illustrates a display at an early stage of play according to some implementations of the invention.

In step 105, M playing cards are displayed for each of the N hands, so that a player may identify each of the M playing cards. M may be any convenient integer. FIG. 1A depicts one such display, wherein N is 4 and M is 3. Hands 135, 145, 155 and 165 have been dealt from decks 130, 140, 150 and 160, respectively. FIG. 1A may be, for example, a display shown on a display device, e.g., of a gaming machine. In FIG. 1A, all cards that have been dealt are displayed; in other implementations, a full hand may be dealt, with M playing cards displayed and the rest of the playing cards dealt face down.

In step 110, a player selects at least one of the hands for continued play. In some implementations, a player may select more than one hand, e.g., for an additional payment. In some implementations, a player may make an additional wager at or near the time of selecting the hand, even if only one hand is selected for continued play. In this example, the player selects hand 135 for continued play because a pair of Queens is already displayed.

Figure 1B:
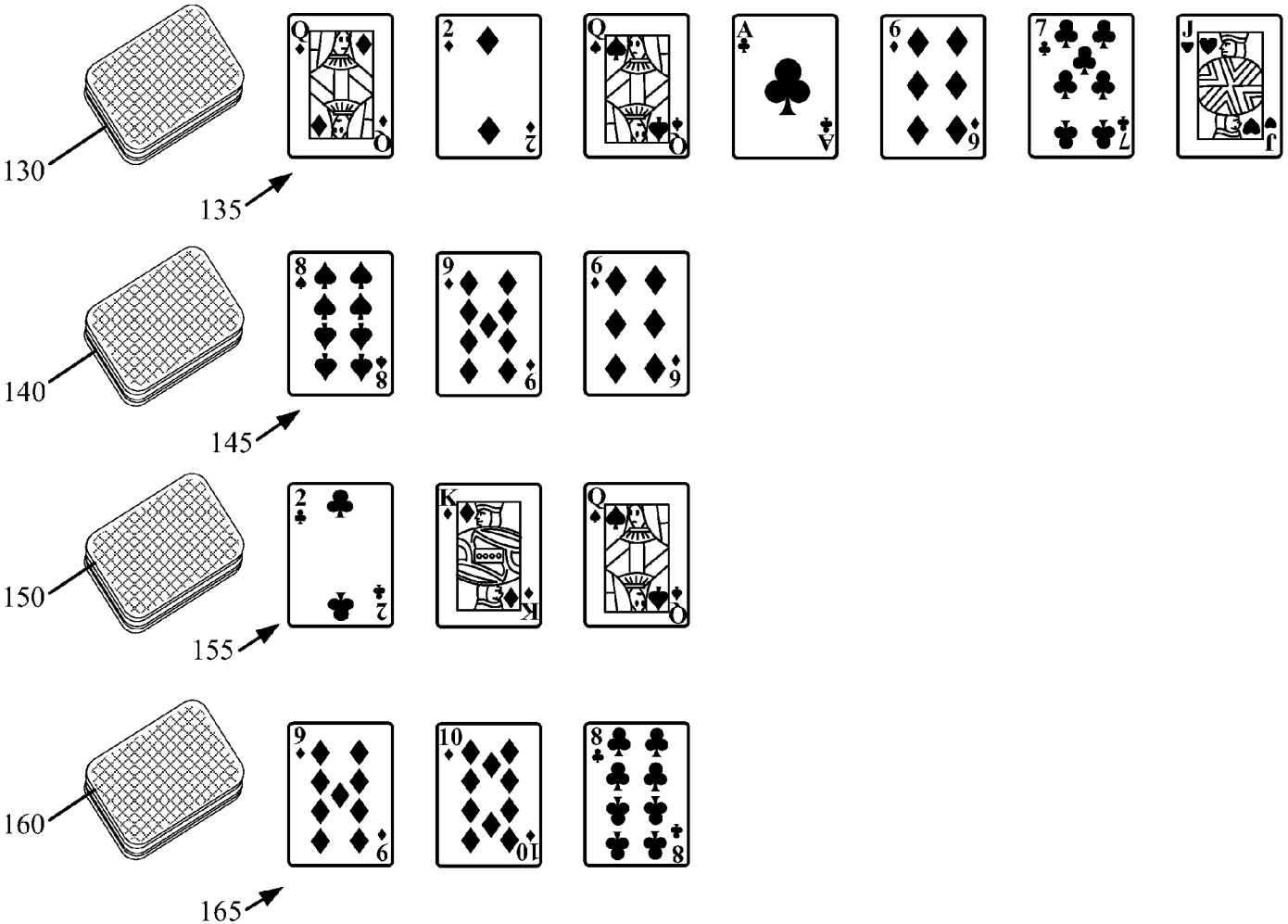
FIG. 1B illustrates a display at a later stage of play according to some implementations of the invention.
Figure 1C:
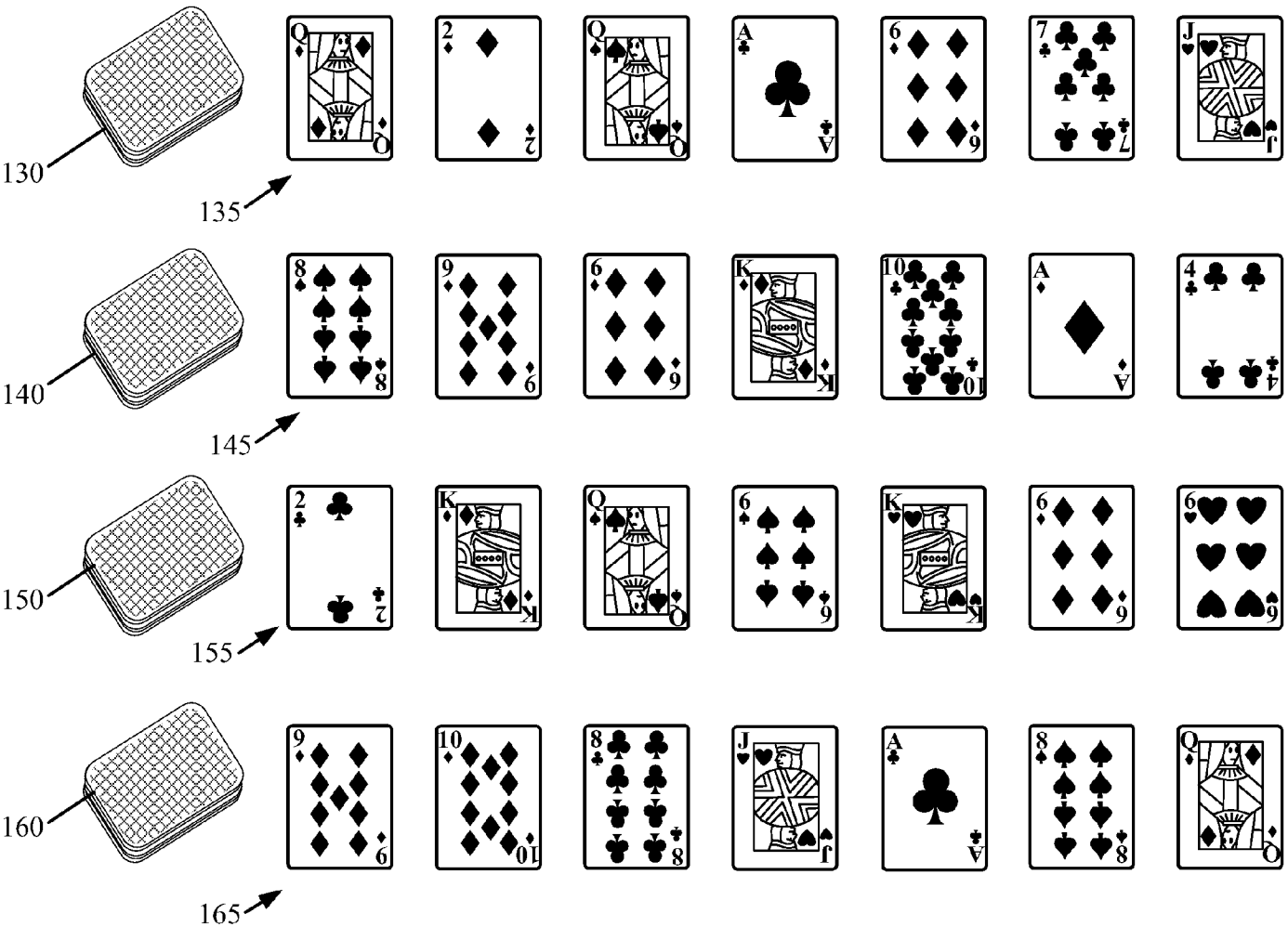
FIG. 1C illustrates a display at a later stage of play according to some implementations of the invention.

In step 115, the remaining playing cards of at least the selected hand are displayed. In the example shown in FIG. 1B, only the remaining playing cards of at least the selected hand are displayed. However, a player will quite naturally be curious about the hands not chosen. Accordingly, some implementations also display the remaining playing cards, as illustrated in FIG. 1C.

The best card combination in the player's final hand (135) is the same pair of Queens that was displayed in step 105, Ace high. In this example, a pair of Queens is not a good enough card combination for the player to win, so in step 120 it is determined (e.g., by a dealer or by a game server) that the player does not have a winning hand. However, if the player had chosen hand 165, the best card combination of the player's final hand would have been a Queen-high straight. In step 120, it would have been determined that the player had a winning hand and the player would have received an award (step 125).

Figure 2:
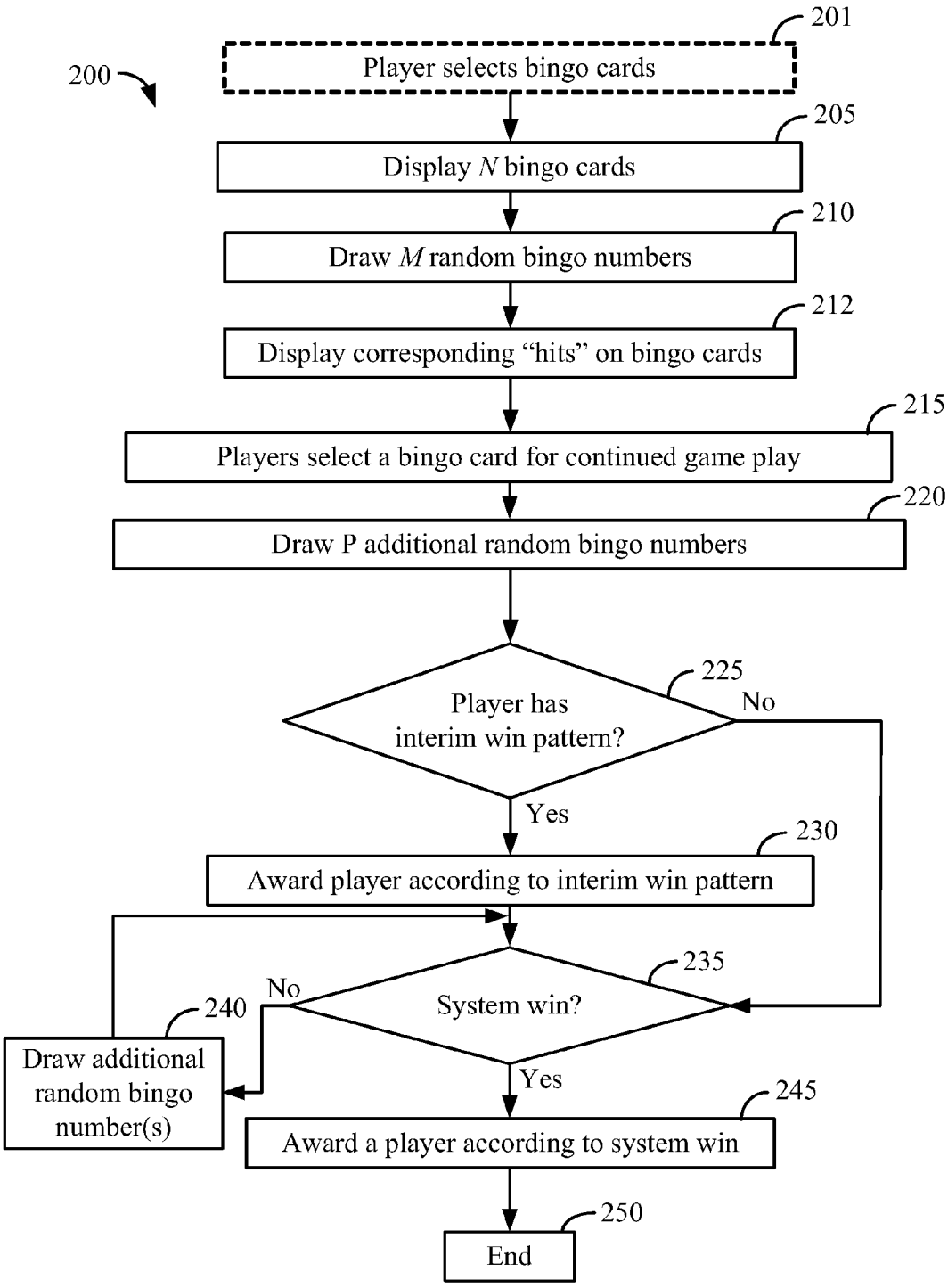
FIG. 2 is a flow chart that outlines some alternative methods of the present invention.

FIG. 2 is a flow chart that depicts method 200 according to the present invention. Method 200 may be performed manually, by devices in a gaming network such as those described below, or otherwise. Those of skill in the art will appreciate that the steps of method 200 need not be performed (and in some implementations are not performed) in the order shown. Moreover, some implementations of method 200 may include more or fewer steps than those shown in FIG. 2.

In step 205, N bingo cards are displayed to a player, e.g., on a display device of a gaming machine. Here, the player has already made a wager and the wager prompted the display. Some implementations of method 200 include an optional previous step 201, wherein a player is presented with additional bingo cards and selects N bingo cards for the initial steps of game play. N may be any convenient integer.

Figure 2A:
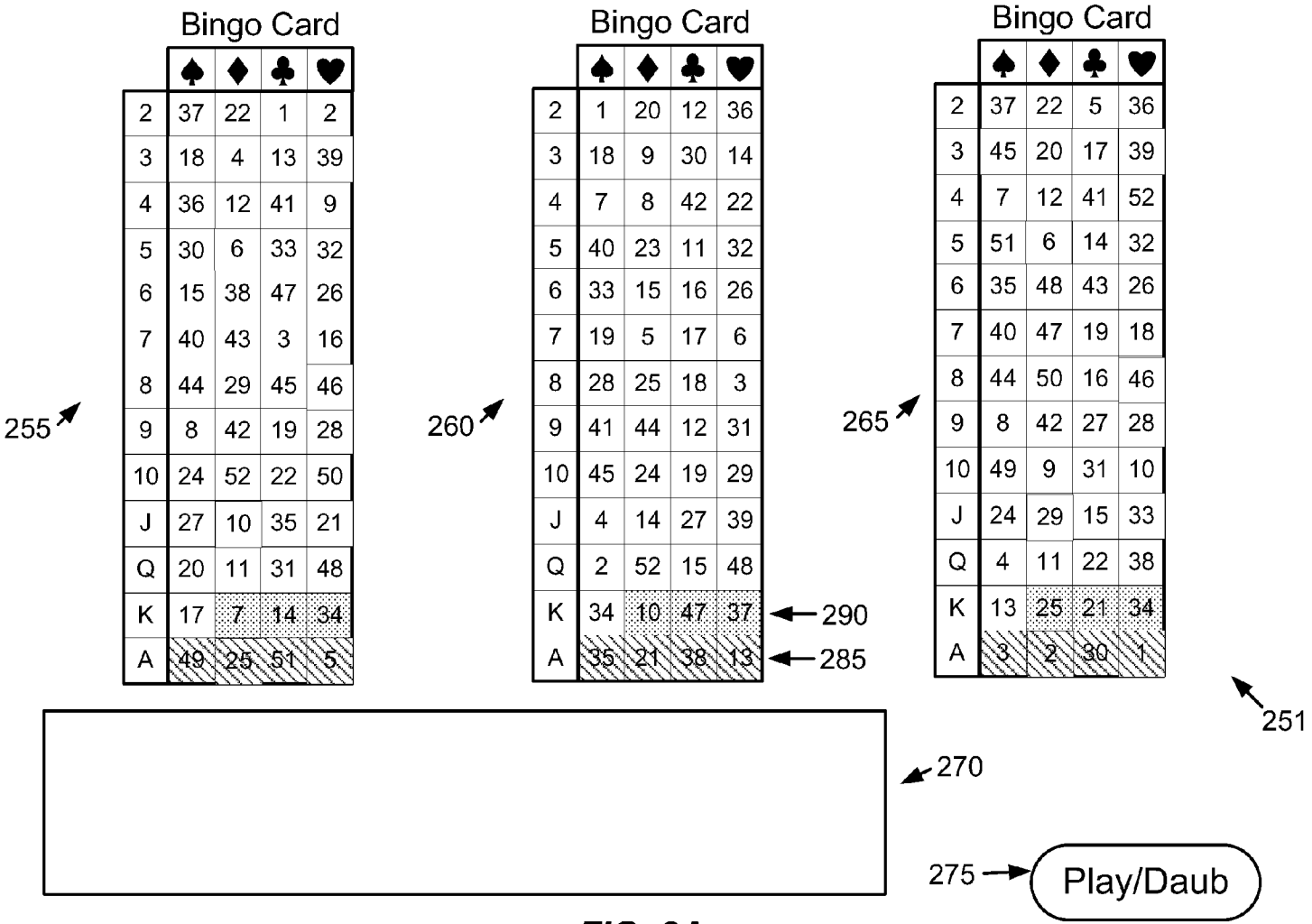
FIG. 2A illustrates a display at an early stage of play according to some implementations of the invention.

One display of N bingo cards according to method 200 is shown in FIG. 2A, wherein N is 3. After a player has made a wager and activated pressing Play/Daub button 275, display 251 depicts bingo cards 255, 260 and 265. In this example, each bingo card includes a correspondence or "mapping" between areas (e.g., squares) on the bingo cards and playing cards. Preferably, each area of a bingo card will correspond to a particular playing card. The playing cards may be, for example, the 52 cards of a standard playing card deck. In some implementations, one or more areas of a bingo card may correspond to a "wild" card of the player's choice.

The type of mapping can vary, according to various implementations of the invention. In some implementations (e.g., as illustrated in FIGS. 2A through 2D), the bingo cards are 4×13 (or 13×4) cards formatted such that rows or columns of the card correspond to playing card suits or denominations, e.g., 2 through Ace. Such implementations provide a bingo card with a square corresponding to all 52 cards of a standard deck. In other implementations, the bingo card is a standard 5×5 bingo card and not all playing cards of a standard deck are mapped to squares of the bingo card. Other implementations use yet other formats of bingo cards. U.S. patent application Ser. No. 10/925,710, filed Aug. 24, 2004 and entitled "Draw Bingo," describes relevant methods and devices and is hereby incorporated in its entirety and for all purposes.

Here, the displayed bingo cards 255, 260 and 265 include game-winning pattern 285, which corresponds to a hand of 4 Aces. Bingo cards 255, 260 and 265 also indicate progressive pattern 290, which includes game-winning pattern 285.

Ball drop display 270 indicates the numbers to be used in playing the bingo game. Those of skill in the art will realize that the numbers used in an electronic bingo game may be displayed in any convenient fashion and that a simulated "ball drop" is merely one such example. As discussed below, the number of balls displayed and the timing of the ball drops may vary according to the implementation.

In step 210, M random bingo numbers are drawn, where M is any convenient integer. In preferred implementations, step 210 will take place after a predetermined number of players has initiated game play. In this example, M is 4 and the random bingo numbers are displayed as numbered balls 280 in ball drop display 270. (See FIG. 2B.) After the ball drop, "hits" are displayed on bingo cards 255, 260 and 265. (Step 212.) Here, the hits on bingo card 255 correspond to a pair of Tens, which is the best card combination indicated on bingo cards 255, 260 and 265.

Accordingly, the player selects bingo card 255 for continued play. (Step 215.) In this example, the player selects bingo card 255 by using a mouse to move arrow 282 near the display of bingo card 255, then pressing Play/Daub button 275. In some preferred implementations, the player selects bingo card 255 by touching areas of a "touch screen" video display screen that is capable of recognizing and identifying the location of the player's touch. For example, when the player touches the areas of the screen where bingo card 255 and Play/Daub button 275 are displayed, the gaming machine receives input similar to a mouse-click in the location of the player touch.

In alternative implementations, the player may use panel buttons to select which bingo card to play. For example, there may be a certain number of buttons (e.g., 4) that light up to prompt the player to make a decision. When the player presses one of the buttons, the card corresponding to that button is selected. According to some such implementations, both touch screen and panel button functionality is provided. For example, when a player wants to select a card to hold or discard, the player can either use the touch screen (e.g., by touching an area of the screen corresponding to the card) or can press a panel button corresponding to the card.

In preferred implementations, each player must select a bingo card within a certain time, so that the bingo game will not be delayed. Otherwise, the player will not be eligible for continued game play.

Figure 2B:
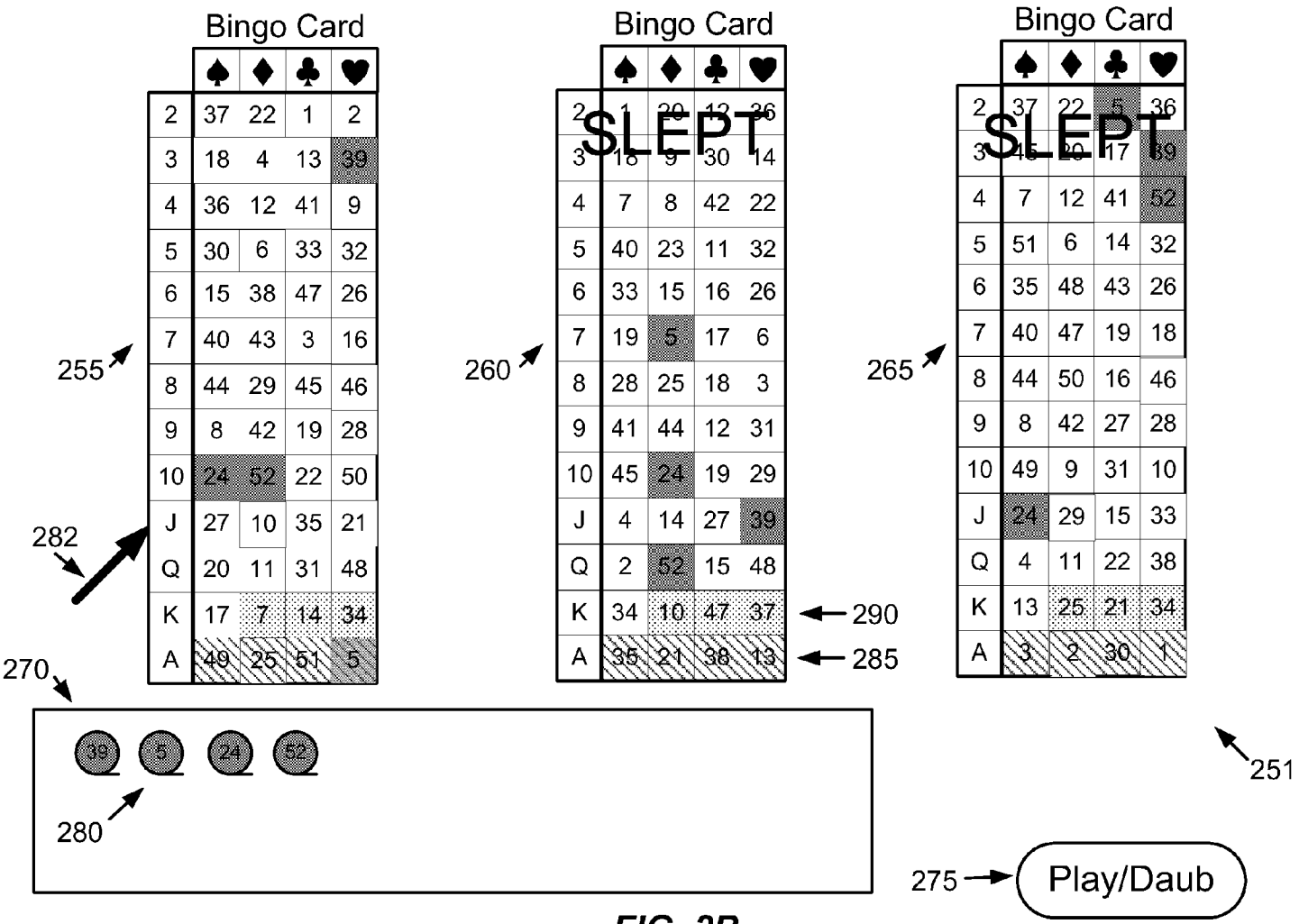
FIG. 2B illustrates a display at a later stage of play according to some implementations of the invention.

Non-chosen bingo cards do not count for continued play. In some implementations, non-chosen or "slept" bingo cards are displayed differently (e.g., with a different color, contrast and/or brightness) as compared to selected bingo cards. For example, non-chosen bingo cards may be labeled "slept," as shown in FIG. 2B or other wise.

In step 220, P additional bingo numbers are drawn. Again, P may be any convenient integer. In some implementations, M and P are selected to total a number of cards in a familiar poker game (e.g., 5 or 7). In other implementations, P is not predetermined, but instead additional bingo numbers are drawn until at least one player has at least a threshold interim win pattern. Because in this implementation areas of the bingo cards map to playing cards, a threshold interim win pattern corresponds to a threshold rank or level of card combination. For example, the threshold card combination could be 3 of a kind, 2 pair, a Flush, or any other predetermined card combination.

Figure 2C:
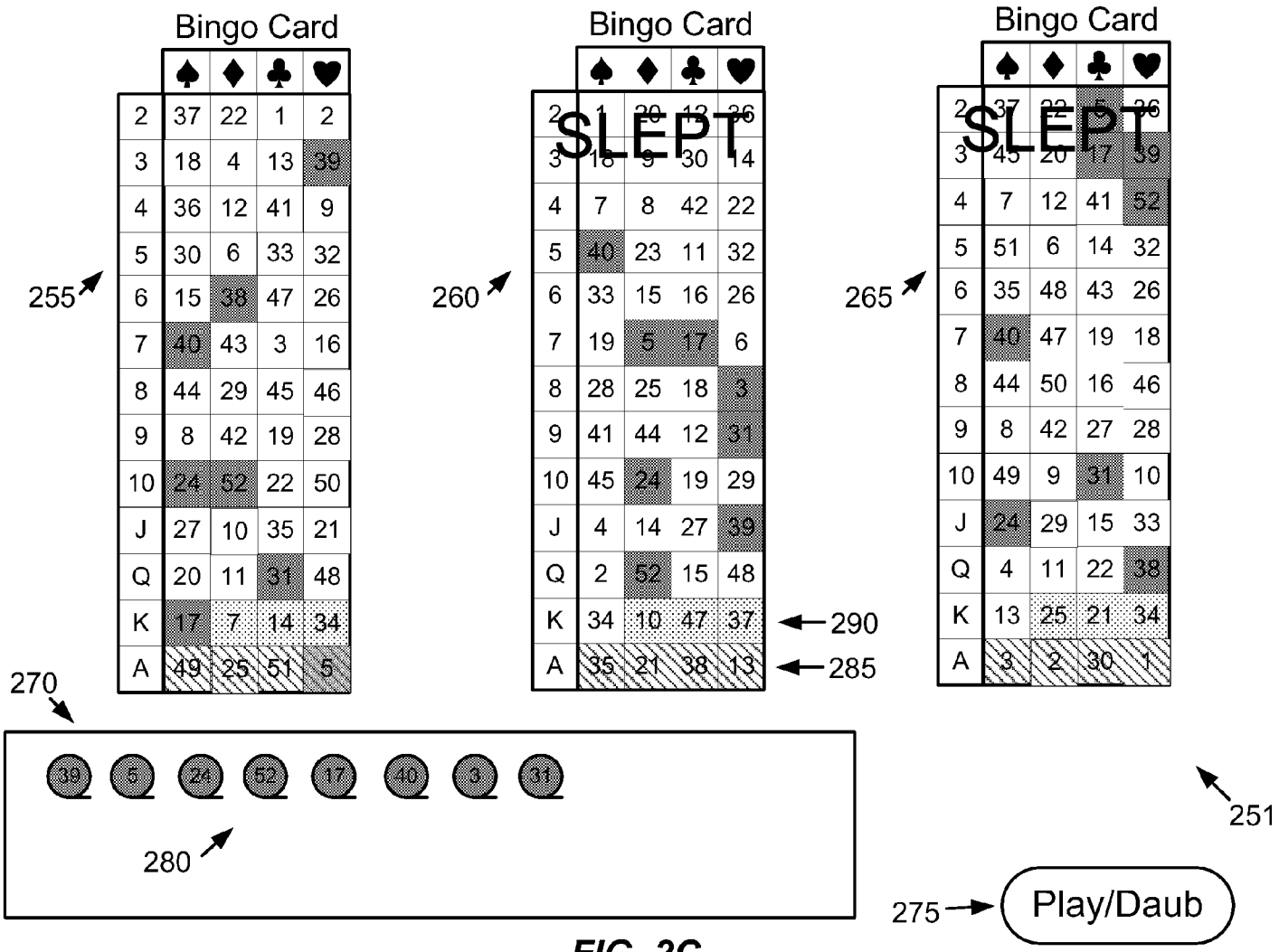
FIG. 2C illustrates a display at a later stage of play according to some implementations of the invention.
Figure 2D:
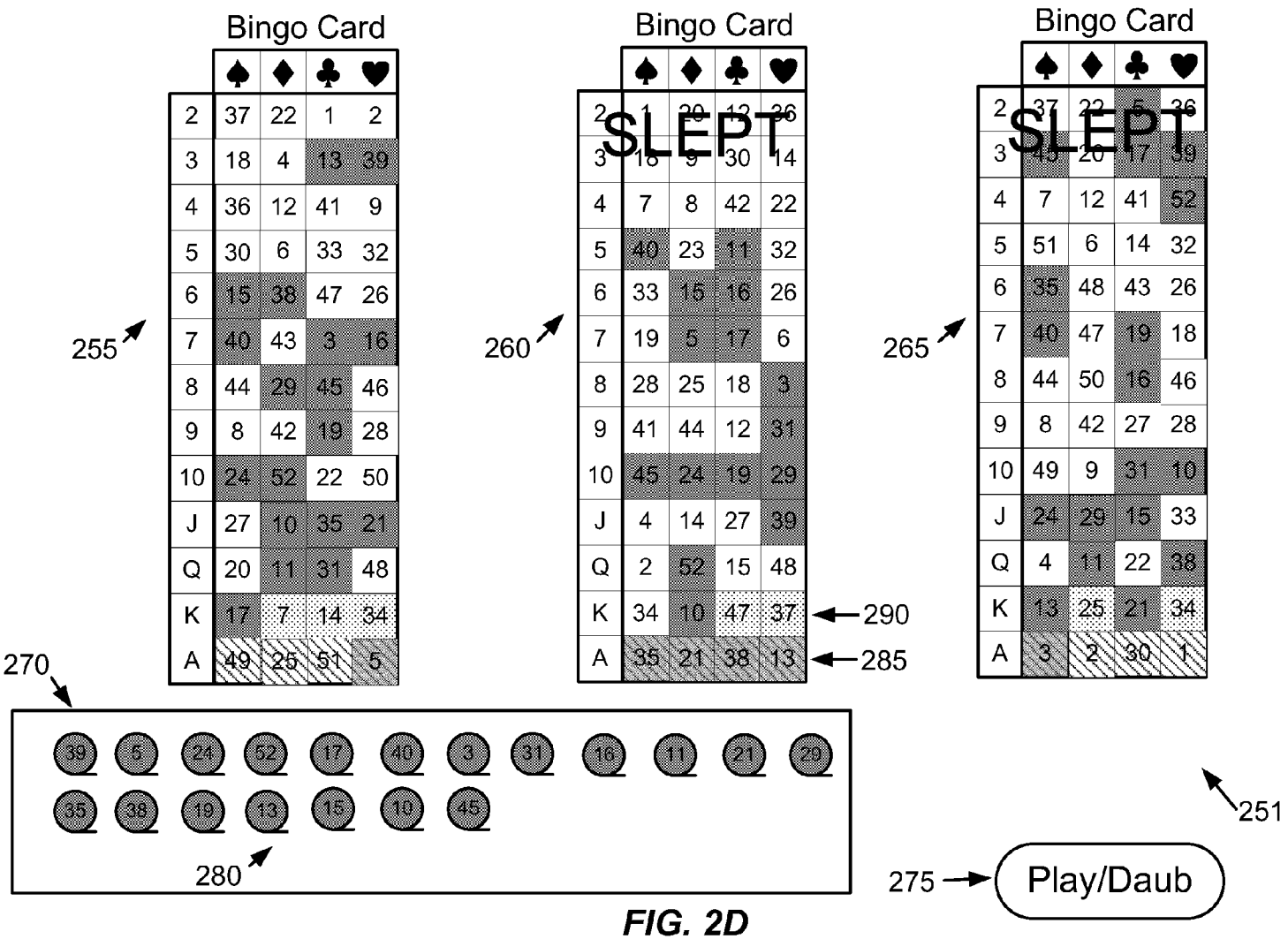
FIG. 2D illustrates a display at a later stage of play according to some implementations of the invention.

In this example, P is a predetermined number (4), as shown in FIG. 2C. Accordingly, there is no guarantee that any player will have an interim pattern after the additional P bingo numbers are drawn. In step 225, it is determined (e.g., by a game server) whether any player has an interim win pattern. If so, the player is awarded. In alternative implementations, the player may need to refuse an offer of an interim win award in order to have a continued chance for a system win.

In step 235, it is determined whether any player has a system win. Here, a player would need to complete pattern 285, corresponding to 4 Aces, in order to have a system win. If no system win is determined at this stage (e.g., as shown in FIG. 2C), additional bingo numbers are drawn. (Step 240.) In this implementation, hits continue to be displayed on slept bingo cards 260 and 265.

The additional bingo numbers are drawn until there one of the players has a system win, at which time the winning player is awarded. (Step 245.) As shown on FIG. 2D, the system win occurred after game-winning pattern 285 on slept bingo card 260 had already been completed: game-winning pattern 285 on slept bingo card 260 was completed after bingo number 13 was drawn. Therefore, the player viewing display 251 would realize that if she had chosen bingo card 260, she might have won the bingo game. (It is possible, however, that another player's slept bingo card would have had its game-winning pattern 285 completed first.)

Some implementations of the present invention may be practiced in the context of central determination games with predetermined outcomes. The following co-pending and commonly owned patent applications describe relevant methods and devices and are hereby incorporated by reference: "GAMING DEVICE INCLUDING OUTCOME POOLS FOR PROVIDING GAME OUTCOMES," Ser. No. 10/261,744, "APPARATUS AND METHOD FOR GENERATING A POOL OF SEEDS FOR A CENTRAL DETERMINATION GAMING SYSTEM," Ser. No. 10/371,722, "CENTRAL DETERMINATION GAMING SYSTEM WITH A CENTRAL CONTROLLER PROVIDING A GAME OUTCOME AND A GAMING TERMINAL DETERMINING A PRESENTATION OF THE PROVIDED GAME OUTCOME," Ser. No. 10/371,723, "CENTRAL DETERMINATION GAMING SYSTEM WHERE THE SAME SEED IS USED TO GENERATE THE OUTCOMES FOR A PRIMARY GAME AND A SECONDARY GAME," Ser. No. 10/371,958, "CENTRAL DETERMINATION GAMING SYSTEM WHICH PROVIDES A PLAYER A CHOICE IN OUTCOMES," Ser. No. 10/442,318, "CENTRAL DETERMINATION GAMING SYSTEM WITH A GAME OUTCOME GENERATED BY A GAMING TERMINAL AND APPROVED BY A CENTRAL CONTROLLER," Ser. No. 10/383,423, "CENTRAL DETERMINATION GAMING SYSTEM WITH A GAMING TERMINAL ASSISTING THE CENTRAL CONTROLLER IN THE GENERATION OF A GAME OUTCOME," Ser. No. 10/431,755, "CENTRAL DETERMINATION GAMING SYSTEM WITH A KENO GAME," Ser. No. 10/601,482, "GAMING DEVICE HAVING AN INTERACTIVE POKER GAME WITH PREDETERMINED OUTCOMES," Ser. No. 10/934,258, "CENTRAL DETERMINATION POKER GAME," Ser. No. 10/945,642, "METHOD FOR DISPLAYING AN INTERACTIVE GAME HAVING A PREDETERMINED OUTCOME," Ser. No. 10/829,578, "METHOD FOR DISPLAYING AN INTERACTIVE GAME HAVING A PREDETERMINED OUTCOME," Ser. No. 10/846,448, and "METHOD FOR DISPLAYING AN INTERACTIVE GAME HAVING A PREDETERMINED OUTCOME," Ser. No. 10/864,784.

Figure 3:
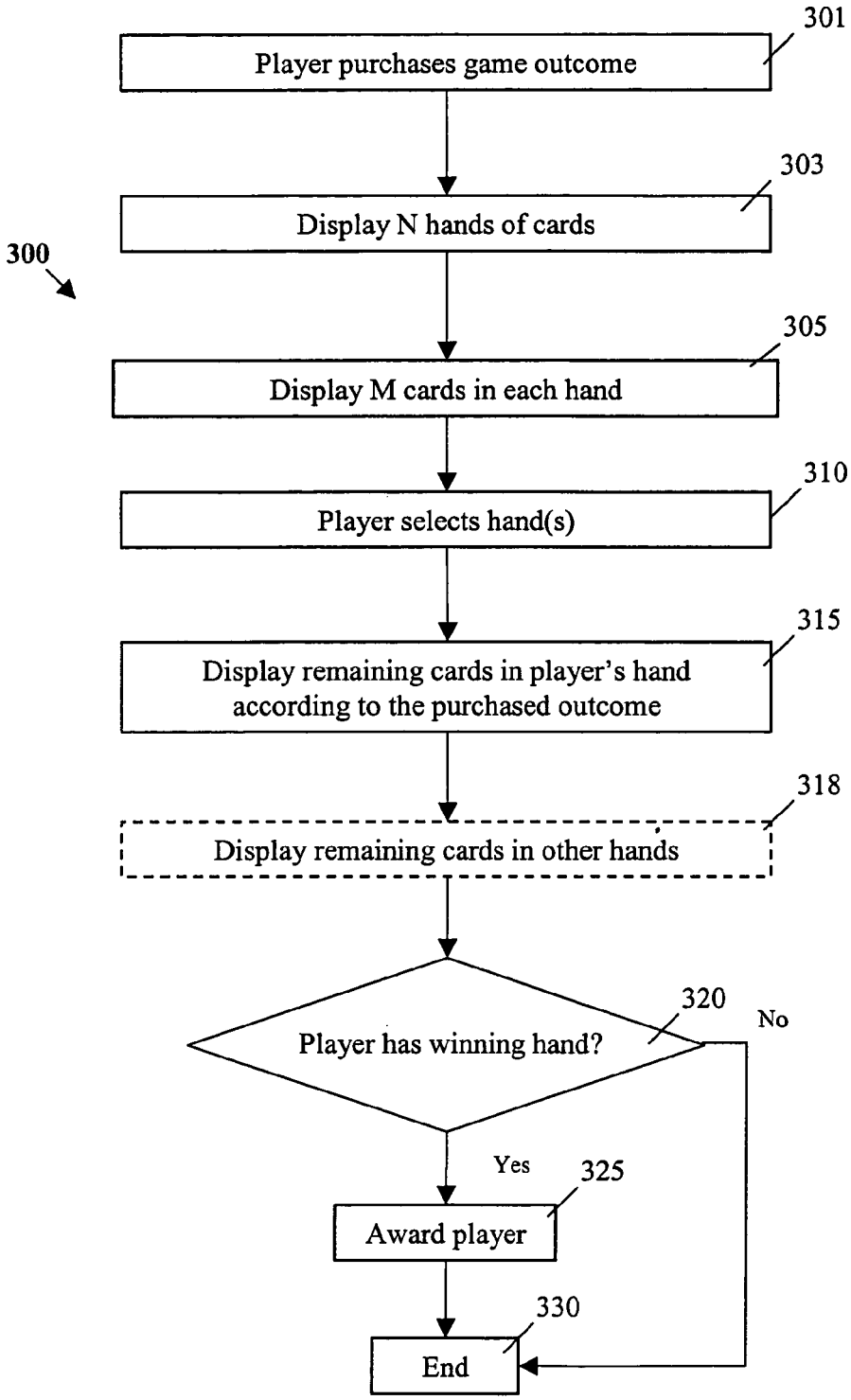
FIG. 3 is a flow chart that outlines other methods of the present invention.

One such method 300 is outlined in the flow chart of FIG. 3. Method 300 may be performed manually, but is preferably performed by devices in a gaming network such as those described below, or by similar devices. Accordingly, the example described below will be described with reference to a gaming network. The steps of method 300 need not be performed (and in some implementations are not performed) in the order shown. Some implementations of method 300 may include more or fewer steps than those shown in FIG. 3.

In step 301, a player purchases a game outcome. In some implementations, the game outcome may be manifested in the form of a tangible medium such as ticket, an RFID card, etc., and may be purchased, for example, from a gaming machine, from a video lottery terminal ("VLT"), from a vendor or from a vending machine. The tangible medium could be inserted into and/or read by the gaming machine or VLT, which would display the outcome as described below. In other implementations, the game outcome may be manifested in electronic form, e.g. as an RNG seed. In such implementations, the game outcome may be requested by the player's gaming machine, VLT, etc., and transmitted from a local or a central server to the requesting machine. U.S. patent application Ser. No. 10/925,727, entitled "PULLTAB/BINGO CONTROLLER," and filed on Aug. 24, 2004, describes relevant methods and devices and is hereby incorporated by reference and for all purposes.

In steps 303 and 305, M playing cards are displayed for each of N hands, so that a player may identify each of the M playing cards. Although M and N may be any convenient integers, the factors noted below should be considered when determining which integers should be selected for M and N. At this point, the display could look similar to FIG. 1A, wherein M is 3 and N is 4.

In step 310, the player selects a hand for continued play. If the player were presented with hands 135, 145, 155 and 165, as shown in FIG. 1A, the player would probably select hand 135 in step 310. However, the card combination in the player's final hand must correspond with the purchased game outcome, regardless of which hand the player selects.

In step 315, the remaining cards in the player's hand are displayed. In this example, the threshold card combination for winning some amount of money was two pair and the game outcome was a "loser." Accordingly, a hand having a card combination rank of less than two pair is displayed in step 315, e.g., as shown in FIG. 1B wherein a pair of Queens, Ace high are displayed.

Preferably, the playing cards in the non-chosen hands are also displayed (optional step 318), because this will create more interest on the part of the player. Moreover, in some implementations, the displays of the non-chosen hands may be selected to suggest that the player could have received a better game outcome than the one revealed in step 315. According to some such implementations, for example, a non-chosen hand could be displayed as a winning hand, whereas different cards would be displayed for the same hand if it had been a chosen hand.

For example, hand 165 might be displayed as a winning hand (e.g., as shown of FIG. 1C) if hand 165 were a non-chosen hand. However, if the player had chosen hand 165 in step 310, hand 165 would need to correspond with the purchased game outcome and therefore would need to have a card combination with a lower rank than two pair. For example, if hand 165 had been chosen it might have been displayed, for example, with a King of Diamonds instead of a Queen of Diamonds. This would have left the player tantalizingly close to having a straight, but still with a losing hand that corresponds to the game outcome purchased in step 301. Accordingly, it would be determined in step 320 that the player has a losing hand.

Conversely, suppose that the player had purchased a winning outcome in step 301 corresponding to a straight. If the player chose hand 165 in step 310, hand 165 could have been displayed as shown in FIG. 1C. It would be determined in step 320 that the player has a winning hand and the player would be awarded in step 325.

It may be seen from the foregoing discussion that M and N should be selected so that it is possible to display a card combination that corresponds to the purchased game outcome regardless of the hand selected in step 310. The fewer cards that are initially displayed, the more options there are for displaying the remaining cards in the chosen and non-chosen hands.

Figure 4:
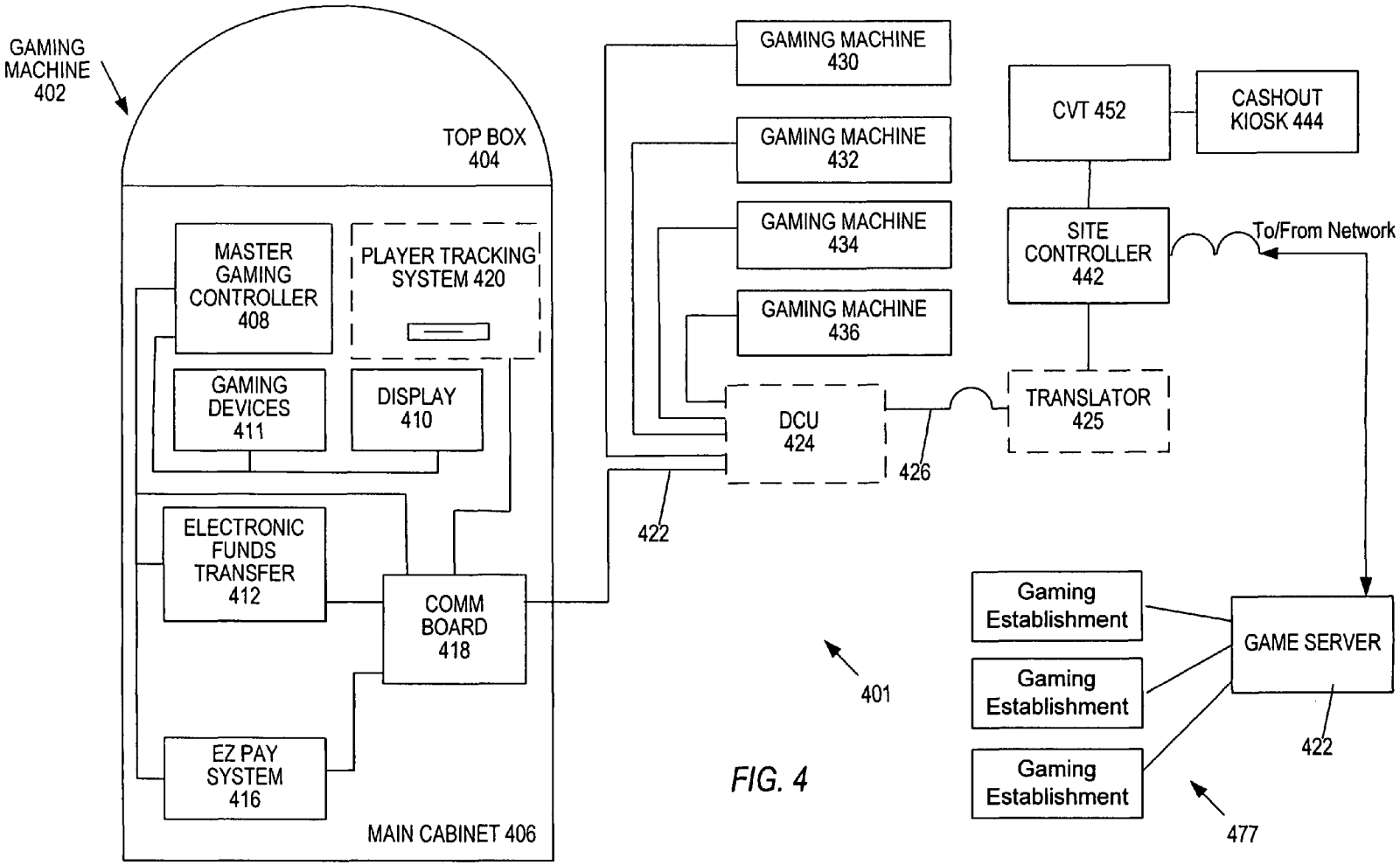
FIG. 4 is a block diagram of a number of gaming machines in a gaming network that may be configured to implement some methods of the present invention.

One example of a gaming machine network that may be used to implement methods of the invention is depicted in FIG. 4. Gaming establishment 401 could be any sort of gaming establishment, such as a casino, a card room, an airport, a store, etc. However, the methods and devices of the present invention are intended for gaming networks (which may be in multiple gaming establishments) in which there is a sufficient number of Class II gaming machines for bingo play. In this example, gaming network 477 includes more than one gaming establishment, all of which are networked to game server 422.

Here, gaming machine 402, and the other gaming machines 430, 432, 434, and 436, include a main cabinet 406 and a top box 404. The main cabinet 406 houses the main gaming elements and can also house peripheral systems, such as those that utilize dedicated gaming networks. The top box 404 may also be used to house these peripheral systems.

The master gaming controller 408 controls the game play on the gaming machine 402 according to instructions and/or game data from game server 422 and receives or sends data to various input/output devices 411 on the gaming machine 402. Details of exemplary systems for using a game server to control a network of gaming machines to implement bingo games are described in U.S. Patent Application No. 60/503,161, filed Sep. 15, 2003 and entitled "Gaming Network with Multi-Player Bingo Game." This application is hereby incorporated by reference for all purposes. The master gaming controller 408 may also communicate with a display 410.

A particular gaming entity may desire to provide network gaming services that provide some operational advantage. Thus, dedicated networks may connect gaming machines to host servers that track the performance of gaming machines under the control of the entity, such as for accounting management, electronic fund transfers (EFTs), cashless ticketing, such as EZPay™, marketing management, and data tracking, such as player tracking. Therefore, master gaming controller 408 may also communicate with EFT system 412, EZPay™ system 416 (a proprietary cashless ticketing system of the present assignee), and player tracking system 420. The systems of the gaming machine 402 communicate the data onto the network 422 via a communication board 418.

It will be appreciated by those of skill in the art that the present invention could be implemented on a network with more or fewer elements than are depicted in FIG. 4. For example, player tracking system 420 is not a necessary feature of the present invention. However, player tracking programs may help to sustain a game player's interest in additional game play during a visit to a gaming establishment and may entice a player to visit a gaming establishment to partake in various gaming activities. Player tracking programs provide rewards to players that typically correspond to the player's level of patronage (e.g., to the player's playing frequency and/or total amount of game plays at a given casino). Player tracking rewards may be free meals, free lodging and/or free entertainment.

Moreover, DCU 424 and translator 425 are not required for all gaming establishments 401. However, due to the sensitive nature of much of the information on a gaming network (e.g., electronic fund transfers and player tracking data) the manufacturer of a host system usually employs a particular networking language having proprietary protocols. For instance, 10-20 different companies produce player tracking host systems where each host system may use different protocols. These proprietary protocols are usually considered highly confidential and not released publicly.

Further, in the gaming industry, gaming machines are made by many different manufacturers. The communication protocols on the gaming machine are typically hard-wired into the gaming machine and each gaming machine manufacturer may utilize a different proprietary communication protocol. A gaming machine manufacturer may also produce host systems, in which case their gaming machine are compatible with their own host systems. However, in a heterogeneous gaming environment, gaming machines from different manufacturers, each with its own communication protocol, may be connected to host systems from other manufacturers, each with another communication protocol. Therefore, communication compatibility issues regarding the protocols used by the gaming machines in the system and protocols used by the host systems must be considered.

A network device that links a gaming establishment with another gaming establishment and/or a central system will sometimes be referred to herein as a "site controller." Here, site controller 442 provides this function for gaming establishment 401. Site controller 442 is connected to a central system and/or other gaming establishments via one or more networks, which may be public or private networks. Among other things, site controller 442 communicates with game server 422 to obtain game data, such as ball drop data, bingo card data, etc.

In the present illustration, gaming machines 402, 430, 432, 434 and 436 are connected to a dedicated gaming network 422. In general, the DCU 424 functions as an intermediary between the different gaming machines on the network 422 and the site controller 442. In general, the DCU 424 receives data transmitted from the gaming machines and sends the data to the site controller 442 over a transmission path 426. In some instances, when the hardware interface used by the gaming machine is not compatible with site controller 442, a translator 425 may be used to convert serial data from the DCU 424 to a format accepted by site controller 442. The translator may provide this conversion service to a plurality of DCUs.

Further, in some dedicated gaming networks, the DCU 424 can receive data transmitted from site controller 442 for communication to the gaming machines on the gaming network. The received data may be, for example, communicated synchronously to the gaming machines on the gaming network.

Here, CVT 452 provides cashless and cashout gaming services to the gaming machines in gaming establishment 401. Broadly speaking, CVT 452 authorizes and validates cashless gaming machine instruments (also referred to herein as "tickets" or "vouchers"), including but not limited to tickets for causing a gaming machine to display a game result and cashout tickets. Moreover, CVT 452 authorizes the exchange of a cashout ticket for cash. These processes will be described in detail below. In one example, when a player attempts to redeem a cashout ticket for cash at cashout kiosk 444, cashout kiosk 444 reads validation data from the cashout ticket and transmits the validation data to CVT 452 for validation. The tickets may be printed by gaming machines, by cashout kiosk 444, by a stand-alone printer, by CVT 452, etc. Some gaming establishments will not have a cashout kiosk 444. Instead, a cashout ticket could be redeemed for cash by a cashier (e.g. of a convenience store), by a gaming machine or by a specially configured CVT.

Figure 5:
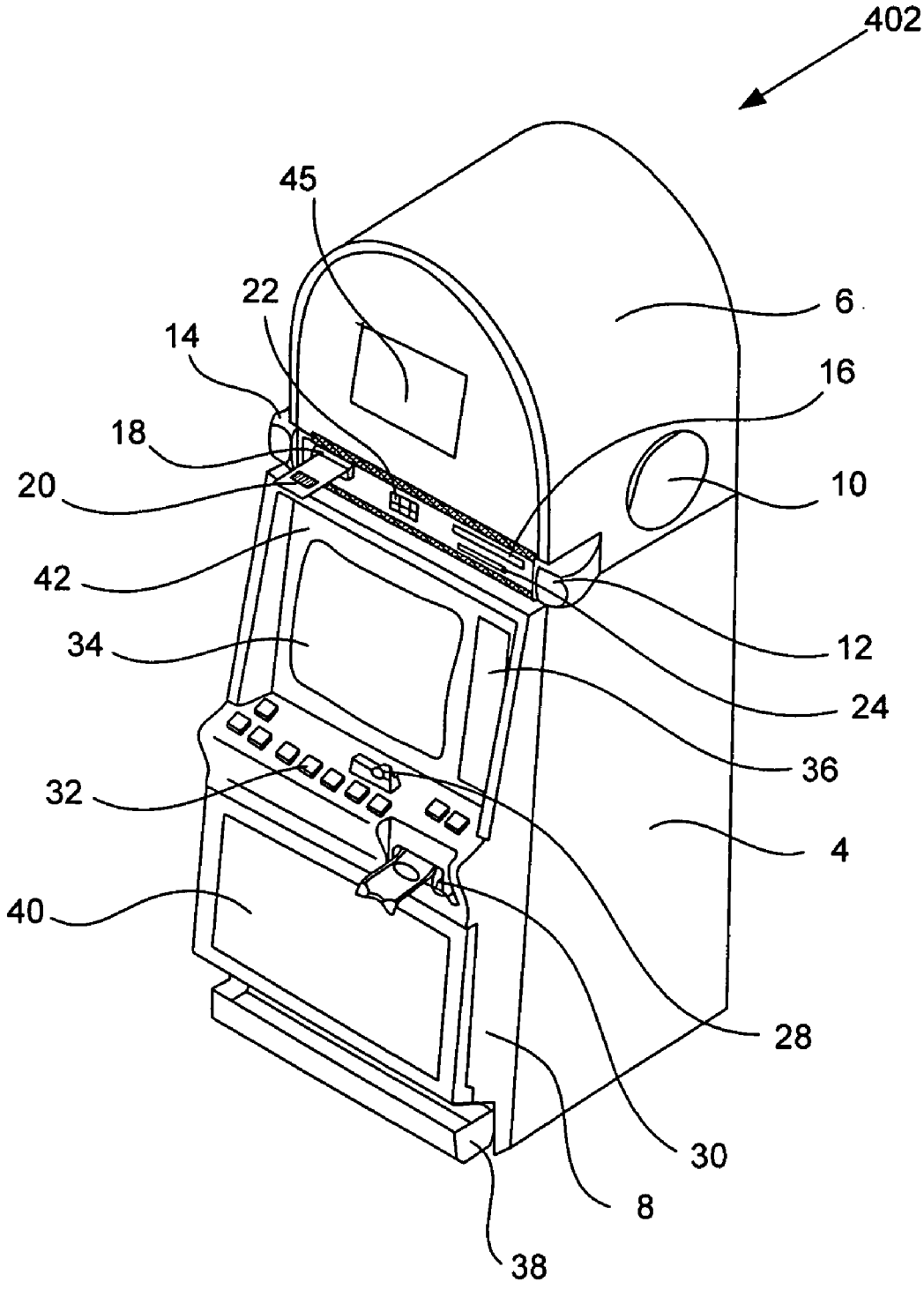
FIG. 5 illustrates an exemplary gaming machine that may be configured to implement some methods of the present invention.

Turning to FIG. 5, more details of gaming machine 402 are described. Machine 402 includes a main cabinet 4, which generally surrounds the machine interior (not shown) and is viewable by users. The main cabinet 4 includes a main door 8 on the front of the machine, which opens to provide access to the interior of the machine. Attached to the main door are player-input switches or buttons 32, a coin acceptor 28, and a bill validator 30, a coin tray 38, and a belly glass 40. Viewable through the main door is a video display monitor 34 and an information panel 36. The display monitor 34 will typically be a cathode ray tube, high resolution flat-panel LCD, or other conventional electronically controlled video monitor. In some preferred embodiments, display monitor 34 is a "touch screen" video display screen that is capable of recognizing and identifying the location of a player touch. The information panel 36 may be a back-lit, silk screened glass panel with lettering to indicate general game information including, for example, the number of coins played. The bill validator 30, player-input switches 32, video display monitor 34, and information panel are devices used to play a game on the game machine 402. The devices are controlled by circuitry housed inside the main cabinet 4 of the machine 402.

The gaming machine 402 includes a top box 6, which sits on top of the main cabinet 4. The top box 6 houses a number of devices, which may be used to add features to a game being played on the gaming machine 402, including speakers 10, 12, 14, a ticket printer 18 which may print bar-coded tickets 20 used as cashless instruments. The player tracking unit mounted within the top box 6 includes a key pad 22 for entering player tracking information, a florescent display 16 for displaying player tracking information, a card reader 24 for entering a magnetic striped card containing player tracking information, a microphone 43 for inputting voice data, a speaker 42 for projecting sounds and a light panel 44 for display various light patterns used to convey gaming information. In other embodiments, the player tracking unit and associated player tracking interface devices, such as 16, 22, 24, 42, 43 and 44, may be mounted within the main cabinet 4 of the gaming machine, on top of the gaming machine, or on the side of the main cabinet of the gaming machine.

Understand that gaming machine 402 is but one example from a wide range of gaming machine designs on which the present invention may be implemented. For example, not all suitable gaming machines have top boxes or player tracking features. Further, some gaming machines have two or more game displays—mechanical and/or video. Some gaming machines are designed for bar tables and have displays that face upwards. Still further, some machines may be designed entirely for cashless systems. Such machines may not include such features as bill validators, coin acceptors and coin trays. Instead, they may have only ticket readers, card readers and ticket dispensers. Those of skill in the art will understand that the present can be deployed on most gaming machines now available or hereafter developed. Moreover, some aspects of the invention may be implemented on devices which lack some of the features of the gaming machines described herein, e.g., workstation, desktop computer, a portable computing device such as a personal digital assistant or similar handheld device, a cellular telephone, etc. U.S. patent application Ser. No. 09/967,326, filed Sep. 28, 2001 and entitled "Wireless Game Player," is hereby incorporated by reference for all purposes.

Returning to the example of FIG. 5, when a user wishes to play the gaming machine 402, he or she inserts cash through the coin acceptor 28 or bill validator 30. In addition, the player may use a cashless instrument of some type to register credits on the gaming machine 402. For example, the bill validator 30 may accept a printed ticket voucher, including 20, as an indicium of credit. As another example, the card reader 24 may accept a debit card or a smart card containing cash or credit information that may be used to register credits on the gaming machine.

During the course of a game, a player may be required to make a number of decisions. For example, a player may vary his or her wager on a particular game, select a prize for a particular game, or make game decisions regarding gaming criteria that affect the outcome of a particular game (e.g., which cards to hold). The player may make these choices using the player-input switches 32, the video display screen 34 or using some other hardware and/or software that enables a player to input information into the gaming machine (e.g. a GUI displayed on display 16).

During certain game functions and events, the gaming machine 402 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 402, from lights behind the belly glass 40 or the light panel on the player tracking unit 44.

After the player has completed a game, the player may receive game tokens from the coin tray 38 or the ticket 20 from the printer 18, which may be used for further games or to redeem a prize. Further, the player may receive a ticket 20 for food, merchandise, or games from the printer 18. The type of ticket 20 may be related to past game playing recorded by the player tracking software within the gaming machine 402. In some embodiments, these tickets may be used by a game player to obtain game services.

IGT gaming machines are implemented with special features and/or additional circuitry that differentiates them from general-purpose computers (e.g., desktop PC's and laptops).

Gaming machines are highly regulated to ensure fairness and, in many cases, gaming machines are operable to dispense monetary awards of multiple millions of dollars. Therefore, to satisfy security and regulatory requirements in a gaming environment, hardware and software architectures may be implemented in gaming machines that differ significantly from those of general-purpose computers. A description of gaming machines relative to general-purpose computing machines and some examples of the additional (or different) components and features found in gaming machines are described below.

At first glance, one might think that adapting PC technologies to the gaming industry would be a simple proposition because both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

For the purposes of illustration, a few differences between PC systems and gaming systems will be described. A first difference between gaming machines and common PC based computers systems is that gaming machines are designed to be state-based systems. In a state-based system, the system stores and maintains its current state in a non-volatile memory, such that, in the event of a power failure or other malfunction the gaming machine will return to its current state when the power is restored. For instance, if a player was shown an award for a game of chance and, before the award could be provided to the player the power failed, the gaming machine, upon the restoration of power, would return to the state where the award is indicated. As anyone who has used a PC, knows, PCs are not state machines and a majority of data is usually lost when a malfunction occurs. This requirement affects the software and hardware design on a gaming machine.

A second important difference between gaming machines and common PC based computer systems is that for regulation purposes, the software on the gaming machine used to generate the game of chance and operate the gaming machine has been designed to be static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used by the master gaming controller to operate a device during generation of the game of chance can require a new EPROM to be burnt, approved by the gaming jurisdiction and reinstalled on the gaming machine in the presence of a gaming regulator. Regardless of whether the EPROM solution is used, to gain approval in most gaming jurisdictions, a gaming machine must demonstrate sufficient safeguards that prevent an operator of a gaming machine from manipulating hardware and software in a manner that gives them an unfair and some cases an illegal advantage. The code validation requirements in the gaming industry affect both hardware and software designs on gaming machines.

A third important difference between gaming machines and common PC based computer systems is the number and kinds of peripheral devices used on a gaming machine are not as great as on PC based computer systems. Traditionally, in the gaming industry, gaming machines have been relatively simple in the sense that the number of peripheral devices and the number of functions the gaming machine has been limited. Further, in operation, the functionality of gaming machines were relatively constant once the gaming machine was deployed, i.e., new peripherals devices and new gaming software were infrequently added to the gaming machine. This differs from a PC where users will go out and buy different combinations of devices and software from different manufacturers and connect them to a PC to suit their needs depending on a desired application. Therefore, the types of devices connected to a PC may vary greatly from user to user depending in their individual requirements and may vary significantly over time.

Although the variety of devices available for a PC may be greater than on a gaming machine, gaming machines still have unique device requirements that differ from a PC, such as device security requirements not usually addressed by PCs. For instance, monetary devices, such as coin dispensers, bill validators and ticket printers and computing devices that are used to govern the input and output of cash to a gaming machine have security requirements that are not typically addressed in PCs. Therefore, many PC techniques and methods developed to facilitate device connectivity and device compatibility do not address the emphasis placed on security in the gaming industry.

To address some of the issues described above, a number of hardware/software components and architectures are utilized in gaming machines that are not typically found in general purpose computing devices, such as PCs. These hardware/software components and architectures, as described below in more detail, include but are not limited to watchdog timers, voltage monitoring systems, state-based software architecture and supporting hardware, specialized communication interfaces, security monitoring and trusted memory.

A watchdog timer is normally used in IGT gaming machines to provide a software failure detection mechanism. In a normally operating system, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits contain a loadable timeout counter register to allow the operating software to set the timeout interval within a certain range of time. A differentiating feature of the some preferred circuits is that the operating software cannot completely disable the function of the watchdog timer. In other words, the watchdog timer always functions from the time power is applied to the board.

IGT gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modern general-purpose computers include voltage monitoring circuitry, these types of circuits only report voltage status to the operating software. Out of tolerance voltages can cause software malfunction, creating a potential uncontrolled condition in the gaming computer. Gaming machines of the present assignee typically have power supplies with tighter voltage margins than that required by the operating circuitry. In addition, the voltage monitoring circuitry implemented in IGT gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for IGT slot machine game software is to use a state machine. Each function of the game (bet, play, result, etc.) is defined as a state. When a game moves from one state to another, critical data regarding the game software is stored in a custom non-volatile memory subsystem. In addition, game history information regarding previous games played, amounts wagered, and so forth also should be stored in a non-volatile memory device. This feature allows the game to recover operation to the current state of play in the event of a malfunction, loss of power, etc. This is critical to ensure the player's wager and credits are preserved. Typically, battery backed RAM devices are used to preserve this critical data. These memory devices are not used in typical general-purpose computers.

IGT gaming computers normally contain additional interfaces, including serial interfaces, to connect to specific subsystems internal and external to the slot machine. As noted above, some preferred embodiments of the present invention include parallel, digital interfaces for high-speed data transfer. However, even the serial devices may have electrical interface requirements that differ from the "standard" EIA RS232 serial interfaces provided by general-purpose computers. These interfaces may include EIA RS485, EIA RS422, Fiber Optic Serial, Optically Coupled Serial Interfaces, current loop style serial interfaces, etc. In addition, to conserve serial interfaces internally in the slot machine, serial devices may be connected in a shared, daisy-chain fashion where multiple peripheral devices are connected to a single serial channel.

IGT Gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this.

Security monitoring circuits detect intrusion into an IGT gaming machine by monitoring security switches attached to access doors in the slot machine cabinet. Preferably, access violations result in suspension of game play and can trigger additional security operations to preserve the current state of game play. These circuits also function when power is off by use of a battery backup. In power-off operation, these circuits continue to monitor the access doors of the slot machine. When power is restored, the gaming machine can determine whether any security violations occurred while power was off, e.g., via software for reading status registers. This can trigger event log entries and further data authentication operations by the slot machine software.

Trusted memory devices are preferably included in an IGT gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the slot machine. The code and data stored in these devices may include authentication algorithms, random number generators, authentication keys, operating system kernels, etc. The purpose of these trusted memory devices is to provide gaming regulatory authorities a root trusted authority within the computing environment of the slot machine that can be tracked and verified as original. This may be accomplished via removal of the trusted memory device from the slot machine computer and verification of the trusted memory device contents in a separate third party verification device. Once the trusted memory device is verified as authentic, and based on the approval of the verification algorithms contained in the trusted device, the gaming machine is allowed to verify the authenticity of additional code and data that may be located in the gaming computer assembly, such as code and data stored on hard disk drives.

Mass storage devices used in a general purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, IGT gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present.

Gaming machines used for Class III games generally include software and/or hardware for generating random numbers. However, gaming machines used for Class II games may or may not have RNG capabilities. In some machines used for Class II games, RNG capability may be disabled.

Figure 6:
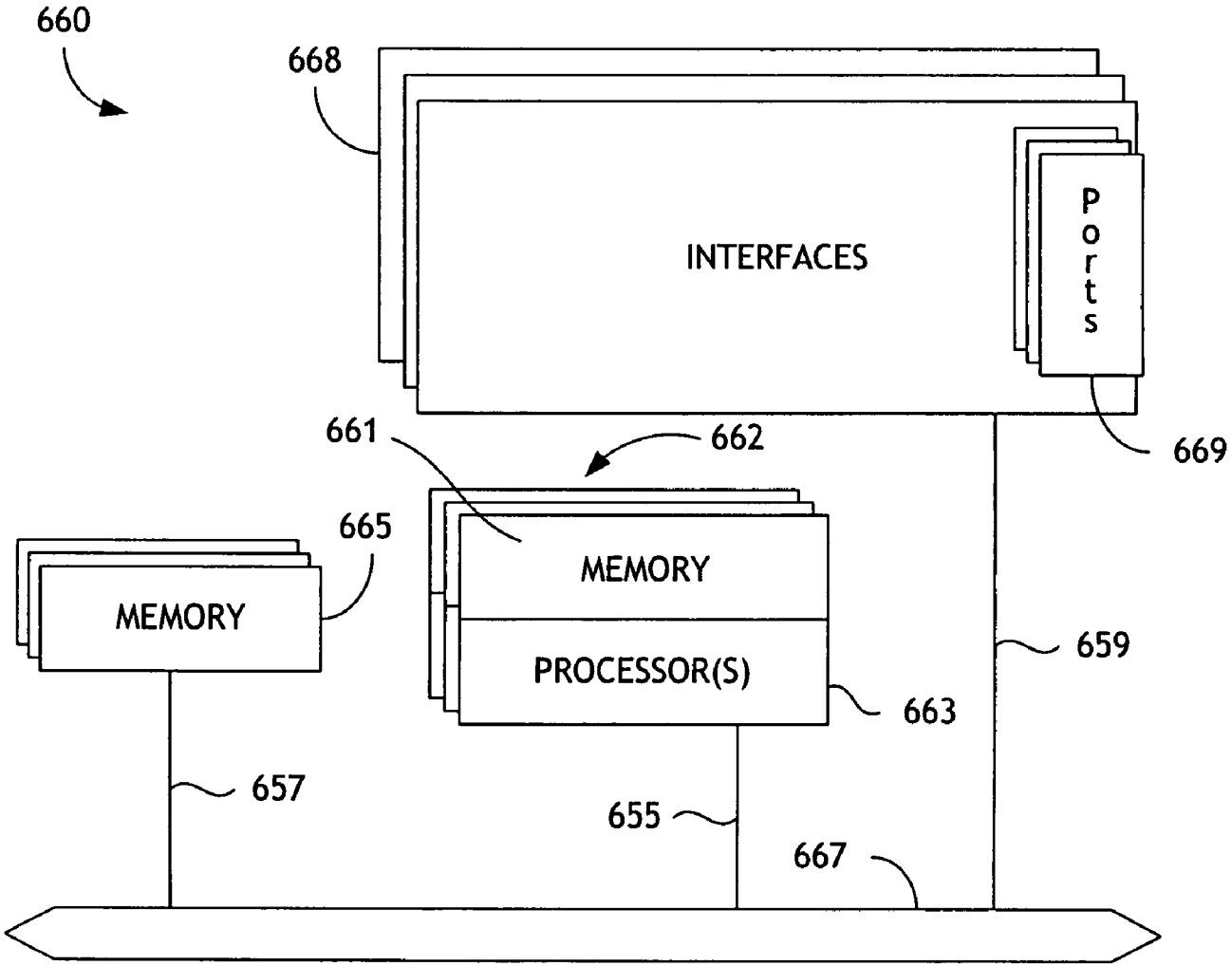
FIG. 6 is a block diagram of an exemplary network device that may be configured as a game server to implement some methods of the present invention.

FIG. 6 illustrates an example of a network device that may be configured as a game server for implementing some methods of the present invention. Network device 660 includes a master central processing unit (CPU) 662, interfaces 668, and a bus 667 (e.g., a PCI bus). Generally, interfaces 668 include ports 669 appropriate for communication with the appropriate media. In some embodiments, one or more of interfaces 668 includes at least one independent processor and, in some instances, volatile RAM. The independent processors may be, for example, ASICs or any other appropriate processors. According to some such embodiments, these independent processors perform at least some of the functions of the logic described herein. In some embodiments, one or more of interfaces 668 control such communications-intensive tasks as media control and management. By providing separate processors for the communications-intensive tasks, interfaces 668 allow the master microprocessor 662 efficiently to perform other functions such as routing computations, network diagnostics, security functions, etc.

The interfaces 668 are typically provided as interface cards (sometimes referred to as "linecards"). Generally, interfaces 668 control the sending and receiving of data packets over the network and sometimes support other peripherals used with the network device 660. Among the interfaces that may be provided are FC interfaces, Ethernet interfaces, frame relay interfaces, cable interfaces, DSL interfaces, token ring interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, DHEI interfaces and the like.

When acting under the control of appropriate software or firmware, in some implementations of the invention CPU 662 may be responsible for implementing specific functions associated with the functions of a desired network device. According to some embodiments, CPU 662 accomplishes all these functions under the control of software including an operating system and any appropriate applications software.

CPU 662 may include one or more processors 663 such as a processor from the Motorola family of microprocessors or the MIPS family of microprocessors. In an alternative embodiment, processor 663 is specially designed hardware for controlling the operations of network device 660. In a specific embodiment, a memory 661 (such as non-volatile RAM and/or ROM) also forms part of CPU 662. However, there are many different ways in which memory could be coupled to the system. Memory block 661 may be used for a variety of purposes such as, for example, caching and/or storing data, programming instructions, etc.

Regardless of network device's configuration, it may employ one or more memories or memory modules (such as, for example, memory block 665) configured to store data, program instructions for the general-purpose network operations and/or other information relating to the functionality of the techniques described herein. The program instructions may control the operation of an operating system and/or one or more applications, for example.

Because such information and program instructions may be employed to implement the systems/methods described herein, the present invention relates to machine-readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media; and hardware devices that are specially configured to store and perform program instructions, such as read-only memory devices (ROM) and random access memory (RAM). The invention may also be embodied in a carrier wave traveling over an appropriate medium such as airwaves, optical lines, electric lines, etc. Examples of program instructions include both machine code, such as produced by a compiler, and files containing higher level code that may be executed by the computer using an interpreter.

Although the system shown in FIG. 6 illustrates one specific network device of the present invention, it is by no means the only network device architecture on which the present invention can be implemented. For example, an architecture having a single processor that handles communications as well as routing computations, etc. is often used. Further, other types of interfaces and media could also be used with the network device. The communication path between interfaces may be bus based (as shown in FIG. 6) or switch fabric based (such as a cross-bar).

The above-described devices and materials will be familiar to those of skill in the computer hardware and software arts. Although many of the components and processes are described above in the singular for convenience, it will be appreciated by one of skill in the art that multiple components and repeated processes can also be used to practice the techniques of the present invention.

Although the foregoing invention has been described in some detail for purposes of clarity of understanding, it will be apparent that certain changes and modifications may be practiced within the scope of the invention and/or within the scope of the appended claims. For example, some implementations of the invention allow a player to view additional cards (and/or additional hits on a bingo card) prior to determining which hand and/or bingo card to select for continued play. In some such implementations, the player may view the first M cards in each hand for a fee, an additional card in each hand for another fee, and so on. In some preferred implementations, the possible payouts to the player are also reduced if the player chooses to view additional cards in advance. Relevant methods and devices are described in U.S. patent application Ser. No. 11/026,860, entitled "Buy a Peek" Gaming Methods and Devices" and filed Dec. 30, 2004, which is hereby incorporated by reference in its entirety.

Alternative implementations of the invention provide at least one draw key (or a similar object) on a display that identifies cards available for a poker draw. U.S. patent application Ser. No. 10/925,710, filed Aug. 24, 2004 and entitled "Draw Bingo," describes relevant methods and devices and has been incorporated in its entirety and for all purposes herein. Preferably, such implementations do not identify the draw cards available until after the player chooses a hand for continued play. The card identification may be made directly (e.g., by playing card symbols) or indirectly, via information from which the cards' identities may be determined. For example, the draw key may indicate numbers displayed on a bingo card, "hits" from a ball drop, etc. Some such implementations provide multiple draw keys and multiple hand displays, allowing a player to play, e.g., multiple simulated poker hands during a single bingo game. Some of the hands may be "slept" hands, as described above.

The invention claimed is:

1. A gaming method, comprising:

receiving a game outcome by a machine that controls a display device;

displaying, on the display device, N bingo cards to each of a plurality of players, where N is a first predetermined integer and wherein each bingo card of the N bingo cards provides a correspondence between areas on the N bingo cards and playing cards;

drawing M random bingo numbers corresponding to areas of at least some of the N bingo cards, where M is a second predetermined integer;

displaying on the display device, hits on the N bingo cards based on the M random bingo numbers;

allowing each player of the plurality of players an opportunity to select at least one bingo card from the N bingo cards for continued game play;

offering, for a fee, to draw one or more extra random bingo numbers in addition to the M random bingo numbers before a bingo card is selected;

drawing, after the at least one bingo card has been selected, additional random bingo numbers; and displaying hits on each player's selected bingo card until at least one interim win pattern is completed.

2. The method of claim 1, further comprising making an interim win award to a player having a chosen bingo card with at least a threshold interim win pattern.

3. The method of claim 1, further comprising displaying hits on non-selected bingo cards.

4. The method of claim 1, further comprising continuing to draw the additional random bingo numbers until a game-winning pattern is completed on a player's selected bingo card.

5. The method of claim 1, further comprising the following steps:

providing the game outcome to each player; and receiving the game outcome by the machine that controls the display device, wherein the displaying comprises displaying game results on the display device that correspond with the game outcome.

6. The method of claim 5, wherein an award, if any, does not depend on which bingo card is chosen.

7. The method of claim 5, further comprising displaying hits on non-chosen bingo cards.

8. The method of claim 7, wherein remaining hits in at least one non-chosen bingo card are selected to have a higher-level pattern than that of a chosen bingo card.

9. Software embodied in a non-transitory machine-readable medium for providing a wagering game, the software comprising instructions for controlling at least one device in a network to do the following:

receive a game outcome by a machine that controls a display device;

display, on the display device, N bingo cards to each of a plurality of bingo players, where N is a first predetermined integer and wherein each bingo card of the N bingo cards provides a correspondence between areas on the N bingo cards and playing cards;

receive M bingo numbers corresponding to areas of at least some of the N bingo cards, where M is a second predetermined integer;

display, on the display device, hits on the N bingo cards based on the M bingo numbers;

allow each player of the plurality of bingo players an opportunity to select at least one bingo card from the N bingo cards for continued game play; and offer, for a fee, to draw one or more extra random bingo numbers before a bingo card is selected;

receive, after the at least one bingo card has been selected, additional bingo numbers and display hits on each player's selected bingo card until at least one interim win pattern is completed.

10. The software of claim 9, further comprising instructions for controlling devices in the network to make an interim win award to a player having a chosen bingo card with at least a threshold interim win pattern.

11. The software of claim 9, further comprising instructions for controlling devices in the network to display hits on non-selected bingo cards.

12. The software of claim 9, further comprising instructions for controlling devices in the network to draw random bingo numbers until a game-winning pattern is completed on a player's selected bingo card.

* * * * *